US006402308B1

(12) United States Patent
Hattori et al.

(10) Patent No.: US 6,402,308 B1
(45) Date of Patent: Jun. 11, 2002

(54) LIQUID SUPPLY SYSTEM AND LIQUID SUPPLY VESSEL USED FOR THE SAME

(75) Inventors: Shozo Hattori, Tokyo; Sadayuki Sugama, Tsukuba; Hajime Yamamoto, Yokohama; Hirofumi Okuhara, Tokyo; Tomoyuki Kaneda, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/598,960

(22) Filed: Jun. 22, 2000

(30) Foreign Application Priority Data

Jun. 24, 1999 (JP) ..... 11-179089

(51) Int. Cl.[7] ..... B41J 2/175
(52) U.S. Cl. ..... 347/86
(58) Field of Search ..... 347/84, 85, 86, 347/87; 220/495.01

(56) References Cited

U.S. PATENT DOCUMENTS

| | | | | |
|---|---|---|---|---|
| 5,509,140 A | | 4/1996 | Koitabashi | 347/86 |
| 5,589,862 A | | 12/1996 | Ujita et al. | 347/87 |
| 5,619,238 A | | 4/1997 | Higuma | 347/86 |
| 5,742,311 A | | 4/1998 | Koitabashi | 347/86 |
| 5,975,330 A | * | 11/1999 | Sasaki et al. | 220/495.01 |
| 6,022,102 A | * | 2/2000 | Ikkatai et al. | 347/85 |

FOREIGN PATENT DOCUMENTS

| | | | | |
|---|---|---|---|---|
| EP | 0 580 443 | | 1/1994 | |
| EP | 0 581 531 | | 2/1994 | |
| EP | 672528 | | 9/1995 | |
| EP | 08034122 | * | 6/1996 | B41J/2/175 |
| EP | 738605 | | 10/1996 | |
| EP | 803364 | | 10/1997 | |
| EP | 0 829 365 | | 3/1998 | |
| EP | 841169 | | 5/1998 | |
| EP | 845362 | | 6/1998 | |
| EP | 860286 | | 8/1998 | |
| EP | 894630 | | 2/1999 | |
| EP | 925935 | | 6/1999 | |
| EP | 956958 | | 11/1999 | |
| GB | 2306401 | | 5/1997 | |
| JP | 7-68776 | | 3/1995 | |
| JP | 10-175311 | | 6/1998 | |
| JP | 11058772 | * | 3/1999 | B41J/2/175 |

OTHER PUBLICATIONS

U.S. Patent Application No. 09/559,754, filed Apr. 27, 2000 (GAU 2861).

U.S. Patent Application No. 09/598,957, filed Jun. 22, 2000 (GAU 2861).

* cited by examiner

*Primary Examiner*—Anh T. N. Vo
(74) *Attorney, Agent, or Firm*—Fitzpatrick, Cella, Harper & Scinto

(57) ABSTRACT

A liquid supply system includes a liquid supply vessel which having a liquid container of accommodating a liquid in a sealed space and a negative pressure producing member containing vessel which internally accommodates a negative pressure producing member capable of internally holding the liquid, has an atmosphere communicating port for communicating the negative pressure producing member with atmosphere and is capable of causing vapor-liquid exchange to discharge the liquid by introducing a gas into the liquid container by way of sections communicated with the liquid supply vessel. The liquid supply system has the communicated section in a plurality each capable of causing vapor-liquid exchange, thereby capable of supplying the liquid stably regardless of environmental changes.

19 Claims, 25 Drawing Sheets

FIG. 2A1
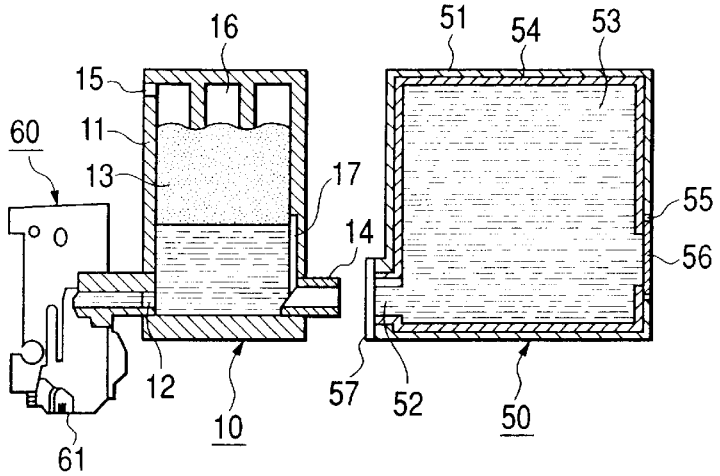
FIG. 2A2
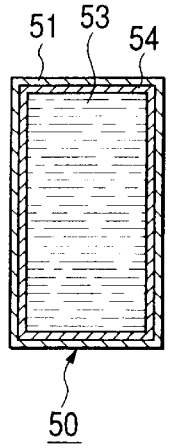
FIG. 2B1
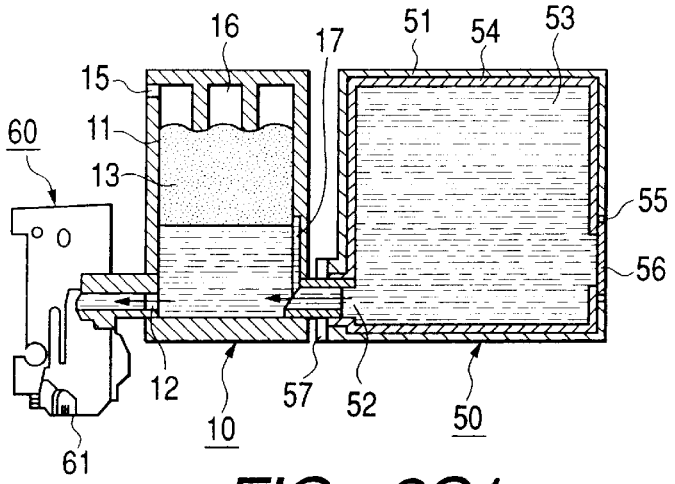
FIG. 2B2
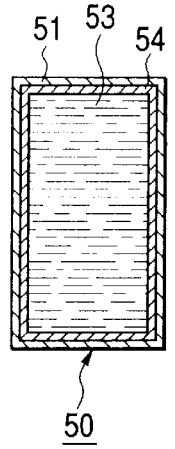
FIG. 2C1
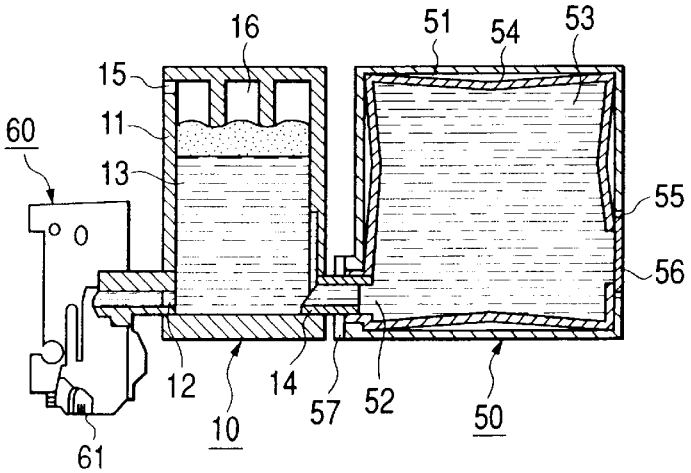
FIG. 2C2
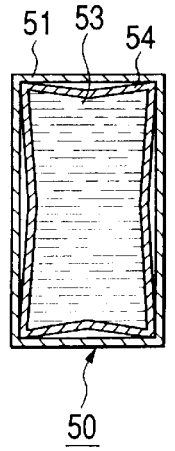

FIG. 3A1
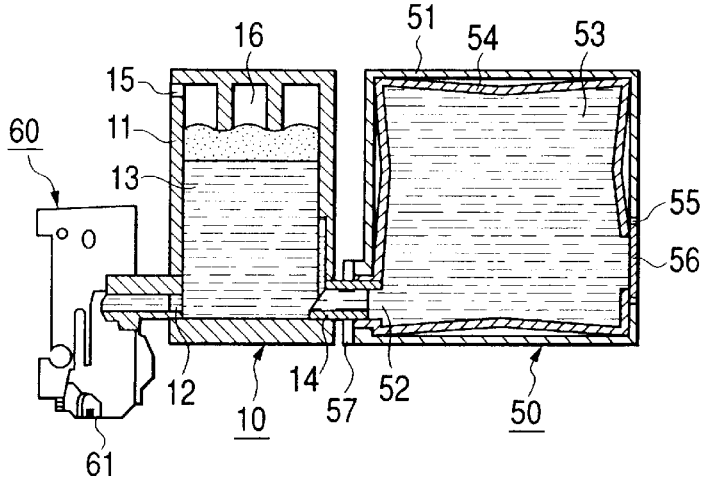
FIG. 3A2
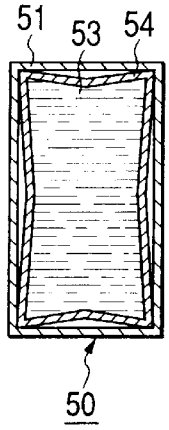
FIG. 3B1
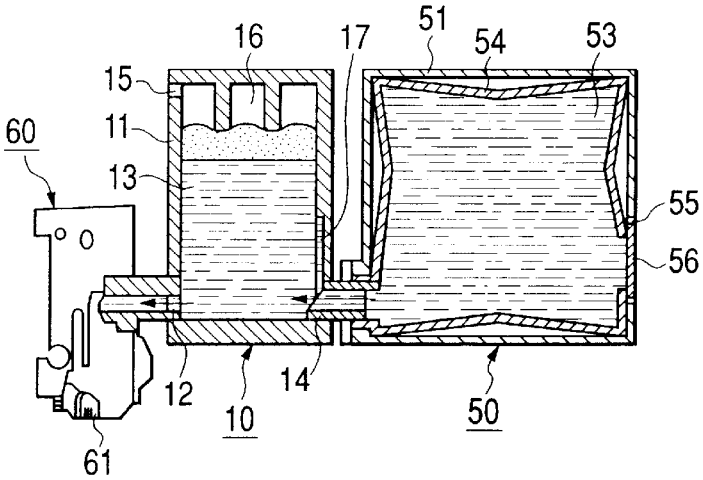
FIG. 3B2
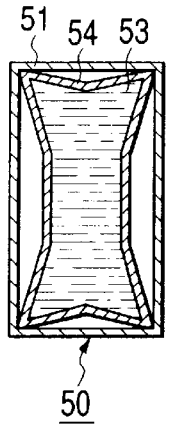
FIG. 3C1
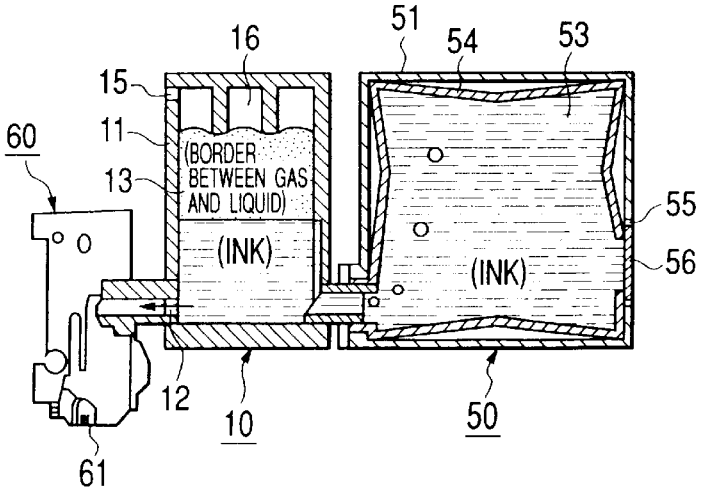
FIG. 3C2
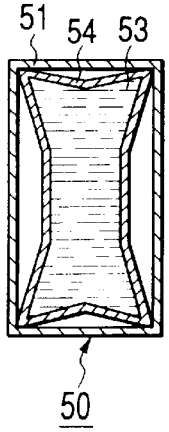

FIG. 4A1
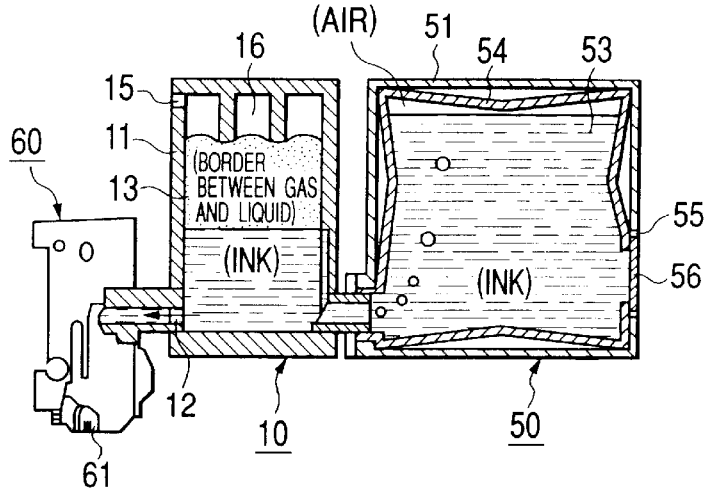
FIG. 4A2
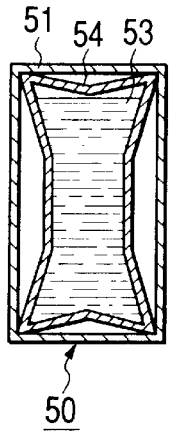
FIG. 4B1
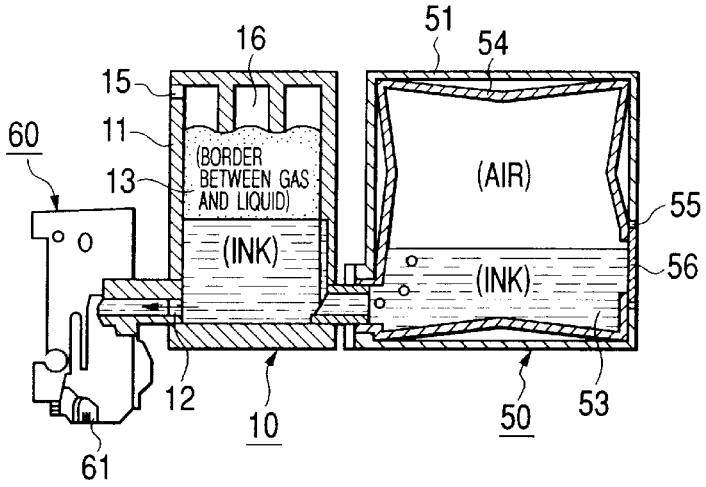
FIG. 4B2
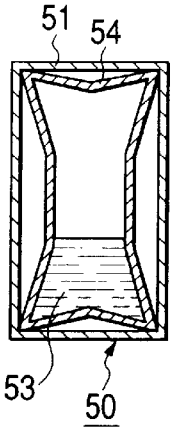
FIG. 4C1
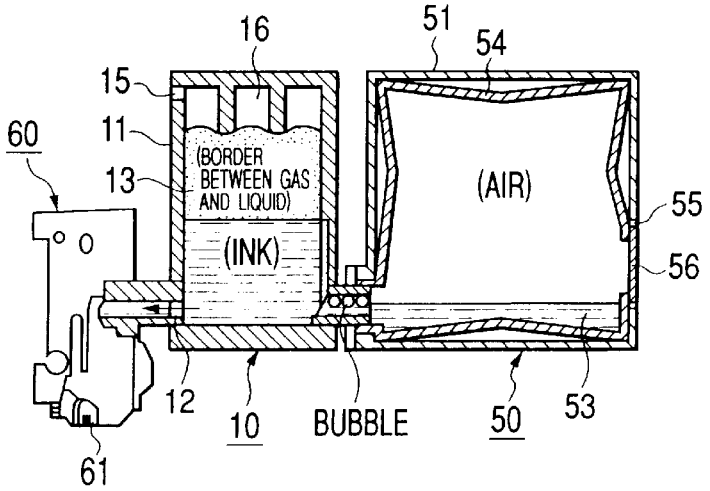
FIG. 4C2
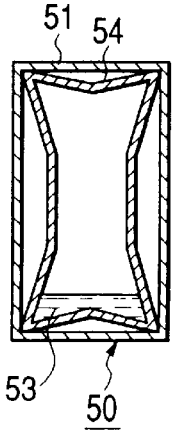

FIG. 5A1
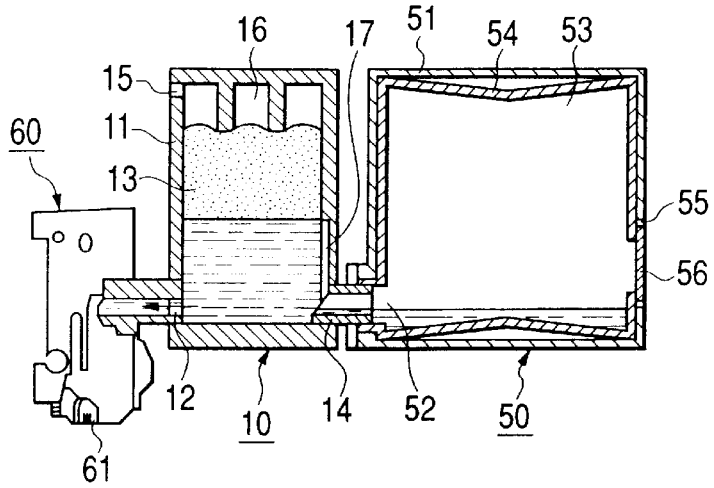
FIG. 5A2
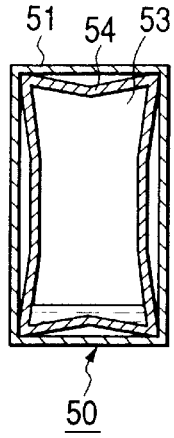
FIG. 5B1
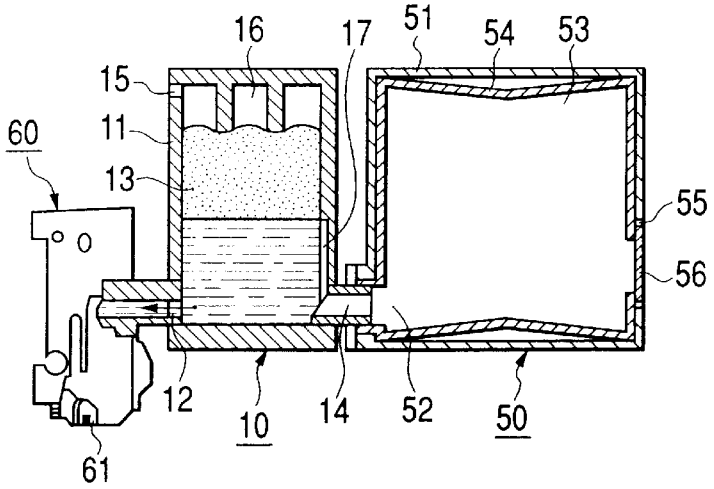
FIG. 5B2
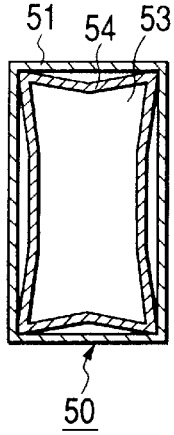
FIG. 5C1
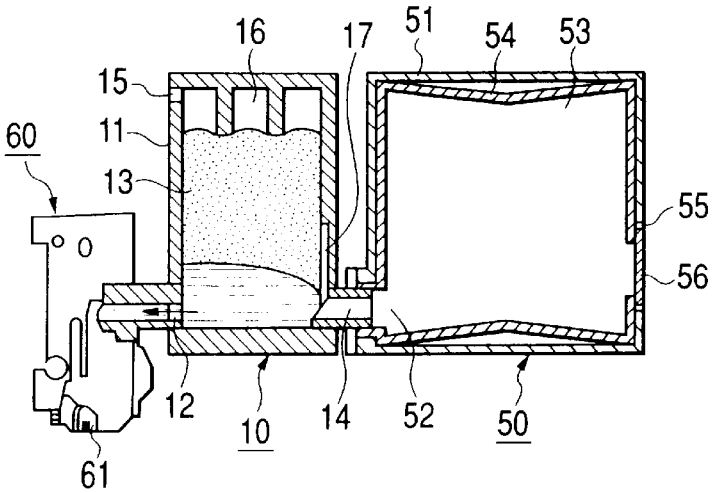
FIG. 5C2
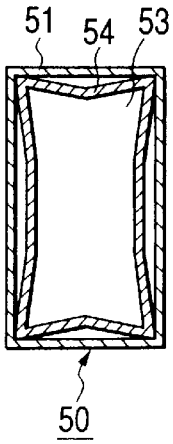

FIG. 9A1
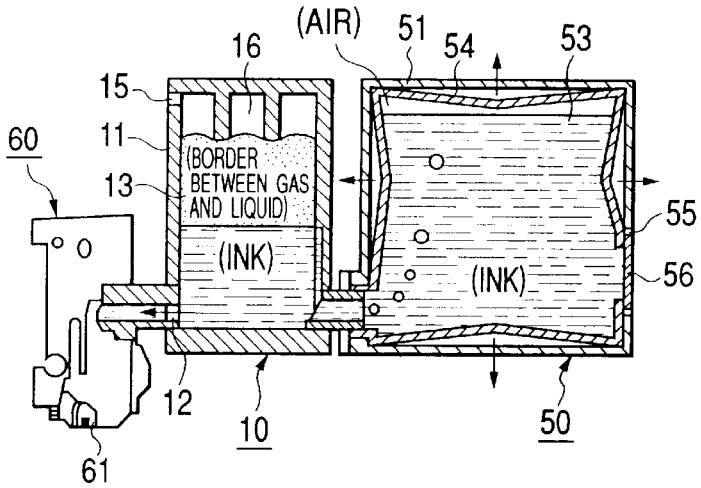
FIG. 9A2
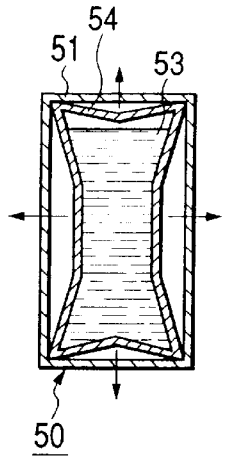
FIG. 9B1
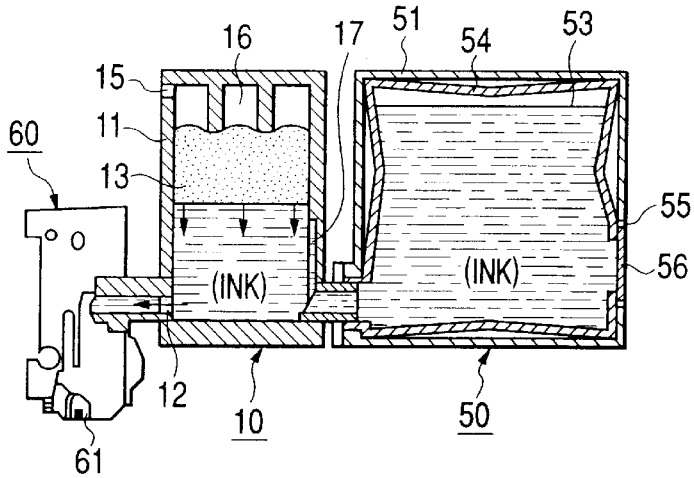
FIG. 9B2
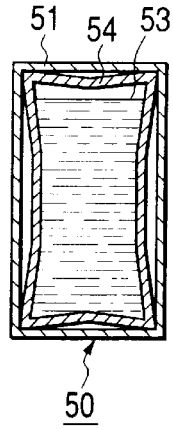
FIG. 9C1
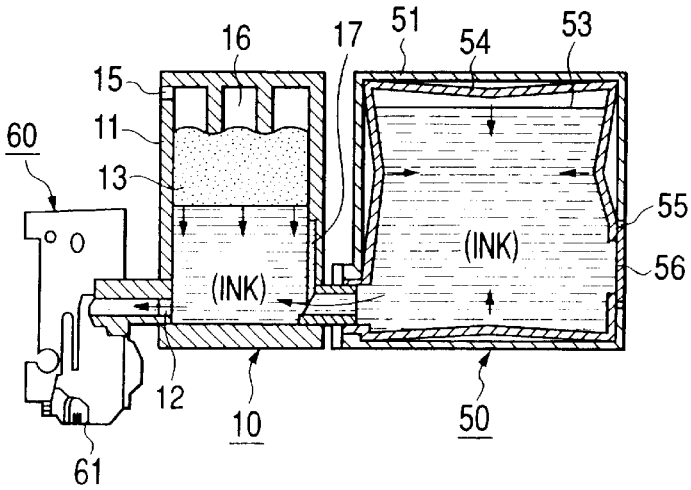
FIG. 9C2
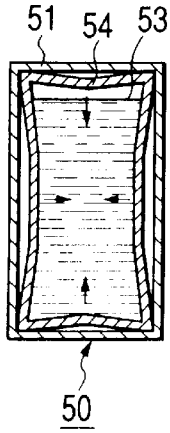

FIG. 11A1
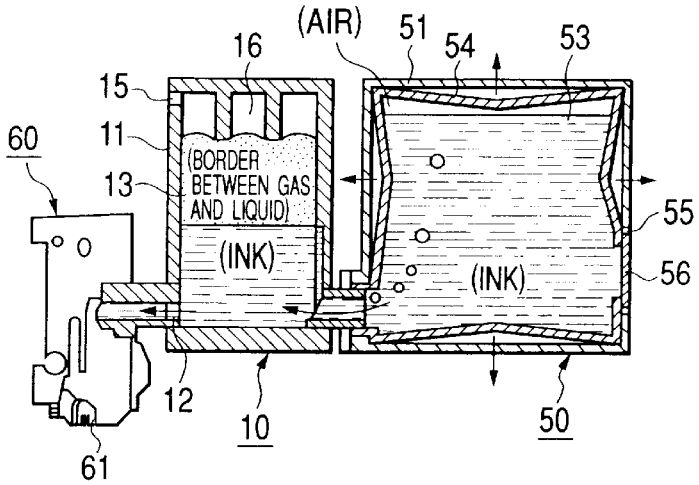
FIG. 11A2
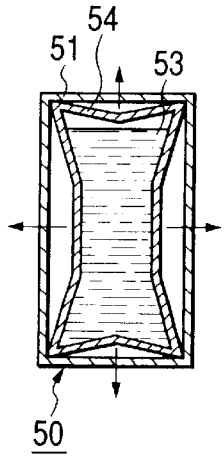
FIG. 11B1
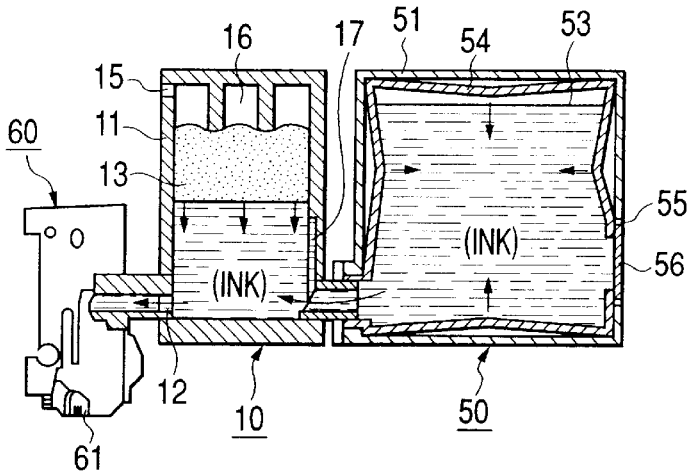
FIG. 11B2
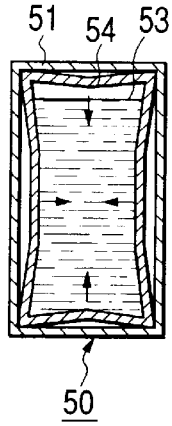
FIG. 11C1
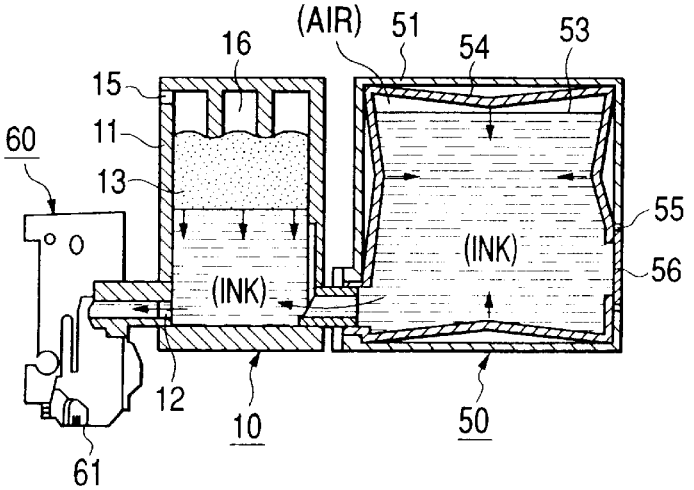
FIG. 11C2
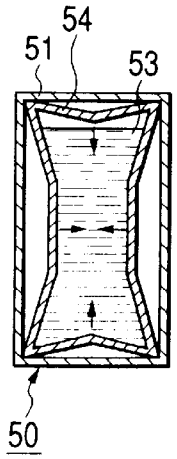

FIG. 13A1
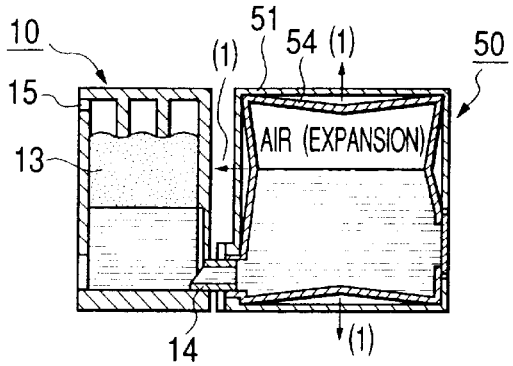
FIG. 13A2
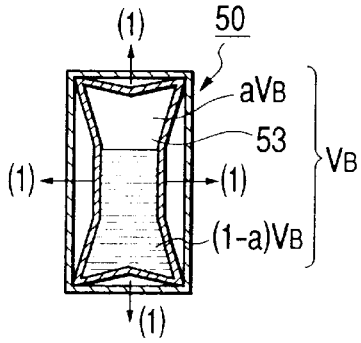
FIG. 13B1
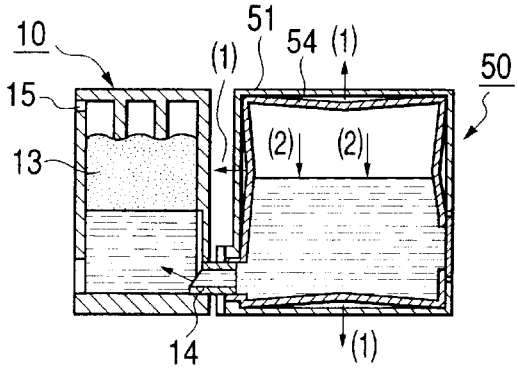
FIG. 13B2
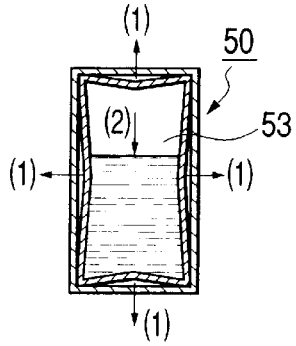
FIG. 13C1
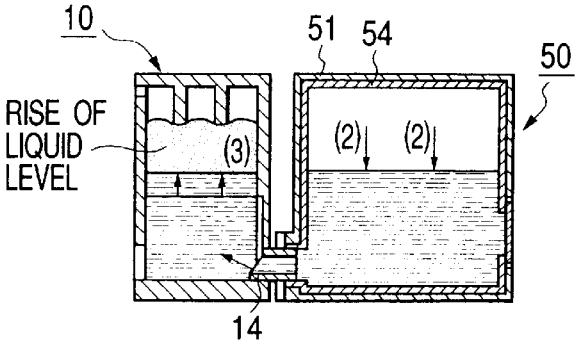
FIG. 13C2
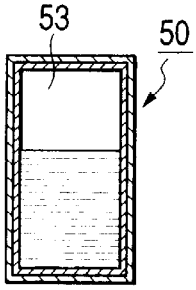
FIG. 13D1
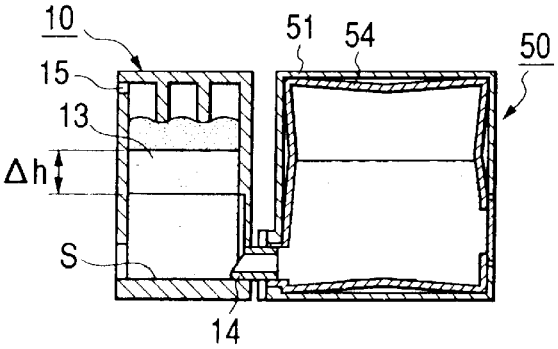
FIG. 13D2
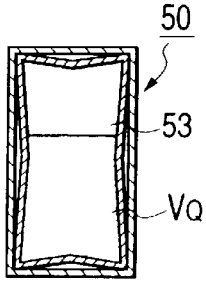

LIQUID SUPPLY SYSTEM AND LIQUID SUPPLY VESSEL USED FOR THE SAME

BACKGROUND OF THE INVENTION

1. Field of the Invention

The present invention relates to a liquid supply system which utilizes a negative pressure to supply a liquid outside, and more concretely a liquid supply system in a liquid-jet recorder which prints or records characters on a recording medium by supplying a liquid to a recording head and a liquid supply vessel to be used in the liquid supply system.

2. Related Background Art

For a liquid supply method which utilizes a negative pressure to supply a liquid outside, for example, in a field of ink-jet recorders, there have conventionally been proposed and adopted ink tanks which apply negative pressures to ink discharge heads and configurations (head cartridges) in which the ink tanks can be integrated with recording heads. The head cartridges can be further classified into a configuration wherein the recording head is always integral with the ink tank (ink container), and another configuration wherein recording means and the ink container are separate from each other, can be separated from the recorder and are integrated for use.

A method which utilizes a capillary force of a porous material is mentioned as an easiest method to produce the negative pressure in such a liquid supply system. An ink tank which is used to carry out this method has a configuration which comprises a porous material such as a sponge accommodated, preferably in a compressed condition, to store ink entirely in the ink tank and an atmosphere communicating port which is capable of introducing air into the ink container for smoothing ink supply during printing.

However, a porous member which is used as an ink holding member poses a problem that the member lowers an ink accommodating efficiency per unit volume. In order to solve this problem, the applicant has proposed in EP0580433 specification an ink tank which has an ink container chamber substantially sealed as a whole except a communicated section from a negative pressure producing member chamber and is used in a condition where the negative pressure producing member chamber is open to atmosphere. Furthermore, the applicant has proposed in EP0581531 specification an invention which makes it possible to exchange the ink container chamber in the ink tank having the above described configuration.

The above described ink tank supplies ink from the ink container chamber into the negative pressure producing member chamber by a vapor-liquid exchange operation whereby the ink container chamber contains gas as the ink is discharged from the ink container chamber, thereby providing a merit that the ink is supplied under a nearly constant negative pressure during the vapor-liquid exchange operation.

On the other hand, the applicant has proposed in EP0738605 specification a liquid container vessel comprising a cabinet which has a substantial form of a prism, and a container which has outside surfaces identical or similar to inside surfaces of the cabinet and is deformable as an internally accommodated liquid is discharged, characterized in that the container is configured so that portions composing angles of the substantial form of the prism are thinner than center areas of the surfaces. This liquid container vessel allows the container to be adequately contracted as the liquid is discharged (a vapor is not exchanged for a liquid in a phenomenon), thereby being capable of supplying the liquid while utilizing a negative pressure. Accordingly, the liquid container vessel is free from a restriction imposed on a location of its installation as compared with a conventional bag like ink container member and can be disposed on a carriage. Furthermore, the invention allows ink to be held directly in the container and is excellent from a viewpoint to enhance an ink accommodating efficiency.

An ink tank of the above described type wherein a negative pressure producing member chamber and an ink container chamber are adjacent to each other causes a vapor-liquid exchange by introducing a gas into the ink container chamber at a stage to supply ink from the ink container chamber which has a predetermined or fixed accommodating space into the negative pressure producing member chamber.

When the ink is supplied from the ink container chamber into the negative pressure producing member chamber, external air is introduced in an amount corresponding to an amount of the supplied ink, whereby the ink and external air exist in the ink container chamber. The external air is swollen due to an environmental change (for example, a temperature difference within a day), whereby the ink may be introduced from the ink container chamber into the negative pressure producing member chamber. For this reason, there have conventionally been reserved in some cases a practically maximum buffer space in the negative pressure producing member taking into consideration a moving amount of the ink at a swollen ratio of the external air together with various environments of use.

Since the conventional vapor-liquid exchange operation allows atmosphere to be introduced by way of the communicated section as the ink is introduced from the ink container chamber into the negative pressure producing member chamber, the conventional vapor-liquid exchange operation is accompanied by a fear that the ink supply may be insufficient for abrupt consumption of the ink in the negative pressure producing member chamber in the case where the ink is to be supplied in a large amount in a short time from the negative pressure producing member chamber to an outside(a discharging head or the like).

SUMMARY OF THE INVENTION

The inventor et al. have already applied an ink supply system of a type which comprises the above described negative pressure producing member chamber and an ink container chamber which is adjacent to the negative pressure producing member chamber and allows the ink container chamber to be exchanged for the negative pressure producing member chamber, wherein the ink supply system is capable of reducing a buffer space in the negative pressure producing member chamber in various environments and supplying ink at a stable negative pressure during use of the ink container chamber while increasing a capacity for swelling of external air introduced by the vapor-liquid exchange, thereby being more excellent in practical utility, and the present invention has been achieved by a more preferable concept of the inventor et al.

In case of the above described exchangeable type ink container chamber, the ink tank which is repeatedly attached and detached is often equipped with a mechanism such as a valve to prevent ink from leaking while the ink tank is detached. In order to open the valve for attaching the ink tank in this case, a coupling section must have a stroke length in contrast to an ink container chamber which is not of the exchangeable type. However, experiments which were carried out by the inventor et al. have clarified a new problem that air bubbles remain and are accumulated in the coupling section dependently on a structure of a coupling section between the ink tank and the negative pressure producing member chamber in such a case where it is necessary to discharge a large amount of ink outside in a short time in particular.

The present invention has been conceived by the inventor et al. to solve the new technical problem described above, and has an object to provide an ink supply system which comprises a negative pressure producing member chamber and an ink container chamber which is adjacent to the negative pressure producing member chamber and the ink container chamber is exchangeable for the negative pressure producing member chamber, wherein the ink supply system is capable of supplying ink more stably as well as an ink tank to be used in the ink supply system.

Another object of the present invention is to apply the above described ink supply system to a liquid supply system having a configuration wherein an ink container chamber is always integrated with a negative pressure producing member chamber, thereby supplying ink more stably even in the liquid supply system which has a configuration described above.

Still another object of the present invention is to provide related inventions which have been achieved in solving the above described new technical problem.

In order to attain the above described objects, a liquid supply system according to the present invention is a liquid supply system which uses a liquid supply vessel which has a liquid container for accommodating a liquid in a sealed space, and a negative pressure producing member containing vessel which accommodates a negative pressure producing member capable of internally holding the above mentioned liquid, has an atmosphere communicating port for communicating the negative pressure producing member with atmosphere and is capable of causing vapor-liquid exchange to discharge the liquid outside by introducing a gas into the liquid container by way of a section communicated with the above mentioned liquid supply vessel, characterized in that the above mentioned communicated section is disposed in a plurality and allows the vapor-liquid exchange.

A liquid supply system in another form of the present invention is a liquid supply system which uses a liquid supply vessel which has a liquid container for accommodating a liquid in a sealed space, and a negative pressure producing member containing vessel which accommodates a negative pressure producing member capable of internally holding the above mentioned liquid, and has an atmosphere communicating port for communicating the negative pressure producing member with atmosphere and a section communicated with the above mentioned liquid supply vessel, characterized in that the communicated section is disposed in a plurality, the plurality of communicated sections are communicated with the liquid container of the liquid supply vessel, the liquid supply vessel can be separated from the negative pressure producing member containing vessel and the plurality of communicated sections have substantially equal heights.

Furthermore, a liquid supply system in still another form of the present invention is a liquid supply system which uses a liquid supply vessel which has a liquid container for accommodating a liquid in a sealed space, and a negative pressure producing member containing vessel which accommodates a negative pressure producing member capable of internally holding the above mentioned liquid, and has an atmosphere communicating port for communicating the negative pressure producing member with atmosphere and a section communicated with the above mentioned liquid supply vessel, characterized in that the communicated section is disposed in a plurality, the plurality of communicated sections are communicated with liquid containers of separate liquid supply vessels and the liquid supply vessels can be separated from the negative pressure producing member containing vessel.

A liquid supply system in still another form of the present invention is a liquid supply system which uses a liquid supply vessel which has a liquid container for accommodating a liquid in a sealed space, and a negative pressure producing member containing vessel which accommodates a negative pressure producing member capable of internally holding the above mentioned liquid, has an atmosphere communicating port for communicating the negative pressure producing member with atmosphere and a section communicated with the above mentioned liquid supply vessel, and is attachable to and detachable from the above mentioned liquid supply vessel, wherein the above mentioned liquid supply vessel is mounted above the negative pressure producing member containing vessel, characterized in that the communicated section is disposed in a plurality and the liquid container of the above mentioned liquid supply vessel can be separated from the negative pressure producing member containing vessel.

Furthermore, the present invention provides also a liquid supply vessel to be used in the liquid supply system described above.

A liquid supply vessel according to the present invention is a liquid supply vessel attachable to and detachable from a negative pressure producing member containing vessel which accommodates a negative pressure producing member capable of internally holding the above mentioned liquid and has an atmosphere communicating port for communicating the negative pressure producing member with atmosphere, characterized in that the above mentioned liquid supply vessel has a plurality of apertures for communication with a plurality of communicated sections disposed in the above mentioned negative pressure producing member containing vessel and a liquid container which accommodates the liquid in a sealed space except the plurality of apertures, and that the plurality of apertures have substantially the same heights relative to a bottom in a condition of use.

Furthermore, a liquid supply vessel in another form of the present invention is a liquid supply vessel attachable to and detachable from a negative pressure producing member containing vessel which accommodates a negative pressure producing member capable of internally holding the above mentioned liquid and has an atmosphere communicating port for communicating the above mentioned negative pressure producing member with atmosphere, characterized in that the liquid supply vessel has a plurality of apertures for communication with a plurality of communicated sections disposed in the above mentioned negative pressure producing member containing vessel and a liquid container for accommodating the liquid in a sealed space except the plurality of apertures, and is mounted above the above mentioned negative pressure producing member containing vessel.

Since a plurality of communicating pipes are disposed in a negative pressure producing member chamber as joints to the liquid supply vessel according to the present invention, some of the communicating pipes can function normally even when air bubbles are accumulated in the other accumulated pipes and these pipes hinder ink from moving from the liquid supply vessel into the negative pressure producing member chamber, thereby making it possible to continue liquid supply. Furthermore, a vapor-liquid exchange operation is carried out positively in the joints which have relatively low resistance to ink out of the plurality of joints when the ink is supplied in a small amount from an ink supply port, whereas the vapor-liquid exchange operation is carried out in the plurality of joints when the ink is supplied in a large amount from the ink supply port. That is, the present invention makes it possible to feed a liquid stably from the liquid supply vessel into the negative pressure producing member chamber for high-speed printing or the like using a plurality of ink supply passages in conjunction with an ink supply speed to an outside.

BRIEF DESCRIPTION OF THE DRAWINGS

FIG. 1A is a perspective view and FIG. 1B is a sectional view;

FIGS. 2A1, 2A2, 2B1, 2B2, 2C1 and 2C2 are schematic diagrams descriptive of conditions of an ink container chamber and a negative pressure producing member chamber of the ink tank shown in FIGS. 1A and 1B at processes of a connecting operation of these chambers;

FIGS. 3A1, 3A2, 3B1, 3B2, 3C1 and 3C2 are schematic diagrams descriptive of a first ink supply condition in the ink tank shown in FIGS. 1A and 1B;

FIGS. 4A1, 4A2, 4B1, 4B2, 4C1 and 4C2 are schematic diagrams descriptive of a second ink supply condition a vapor-liquid exchange condition in the tank shown in FIGS. 1A and 1B;

FIGS. 5A1, 5A2, 5B1, 5B2, 5C1 and 5C2 are schematic diagrams descriptive of changes in the tank caused by liquid discharge after the second ink supply condition in the ink tank shown in FIGS. 1A and 1B;

FIGS. 9A1, 9A2, 9B1, 9B2, 9C1 and 9C2 are diagrams descriptive of ink tank operations in the region A shown in FIG. 7A;

FIGS. 11A1, 11A2, 11B1, 11B2, 11C1 and 11C2 are diagrams descriptive of ink tank operations in the region B shown in FIG. 7A;

FIGS. 13A1, 13A2, 13B1, 13B2, 13C1, 13C2, 13D1 and 13D2 are diagrams descriptive of a mechanism for maintaining a liquid in a stable condition when environmental conditions for the ink tank shown in FIGS. 1A and 1B are changed;

FIG. 22A being a sectional view and FIG. 22B being a plan view of a coupling pipe;

DETAILED DESCRIPTION OF THE PREFERRED EMBODIMENTS

Prior to description of the present invention with reference to the accompanying drawings, explanation will be made of a liquid supply principle of a liquid supply system which is preferably applied to the present invention as follows.

Though description is made in the following embodiments taking ink as an example of liquid to be used in the liquid supply system according to the present invention, a usable liquid is not limited to the ink but includes, needless to say, a treating liquid for a recording medium, for example, in a field of ink-jet recording.

Figure 1A:
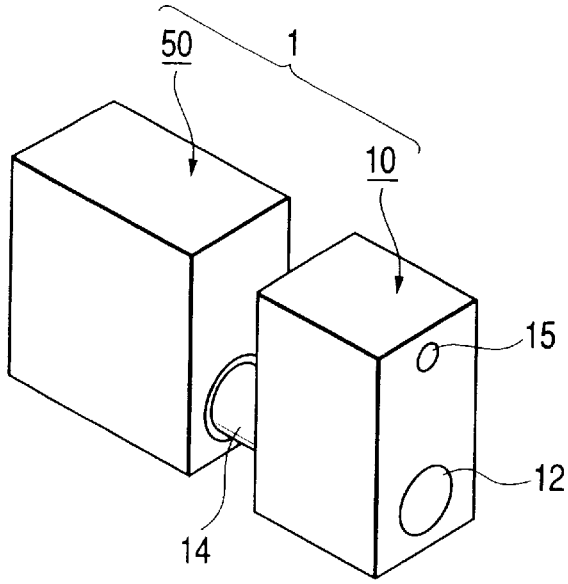
FIGS. 1A and 1B are schematic diagram descriptive of a first embodiment of an ink tank to which the liquid supply system according to the present invention is applicable.
Figure 1B:
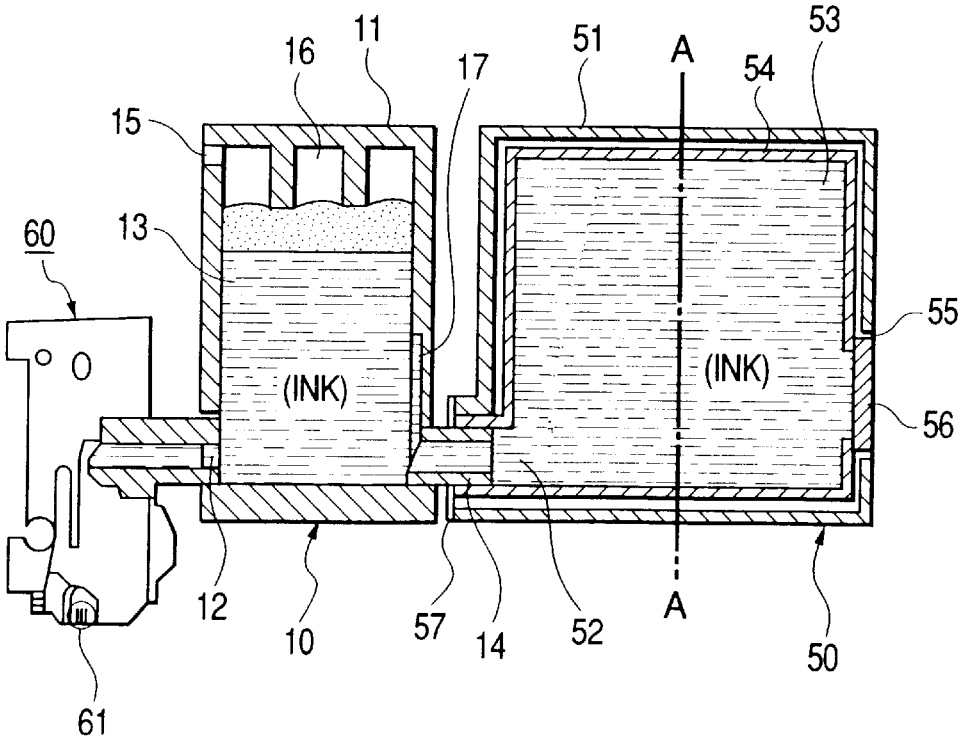

FIGS. 1A and 1B are schematic diagrams of an ink tank to which the liquid supply system according to the present invention is applicable: FIG. 1A is a perspective view and FIG. 1B is a sectional view of the ink tank connected to a recording head.

An ink tank 1 is configured by a negative pressure producing member chamber 10 and an ink container chamber 50 which is separably connected to the negative pressure producing member chamber 10 by way of a communicating pipe (vapor-liquid exchange path) 14.

The negative pressure producing member chamber 10 comprises a cabinet 11 having an ink supply port 12 for supplying ink (including a liquid such as a treating liquid) to an outside such as a recording head member 60 which performs recording by discharging a liquid from a discharge port 61, a negative pressure producing member 13 made of a porous member such as polyurethane foam accommodated in the cabinet, and the communicating pipe (vapor-liquid exchange path) 14 which is in contact with the negative pressure producing member and functions to discharge the liquid from a second chamber. The cabinet 11 is further equipped, inside a side wall in the vicinity of the communicating pipe 14, with an atmosphere inlet groove 17 for accelerating vapor-liquid exchange described later and an atmosphere communicating port 15 for communicating the internally accommodated negative pressure producing member 13 with external air, and a buffer member 16 which is composed of a rib protruding from an inside surface of the cabinet is disposed in the vicinity of the atmosphere communicating port 15. In this embodiment, the vapor-liquid exchange path 14 is in contact with the negative pressure producing member 13 and has an end continuous to the atmosphere inlet groove 17, thereby being capable of smoothly carrying out a vapor-liquid exchange operation described later.

On the other hand, the ink container chamber 50 comprises a cabinet (outside wall) 51 which composes a chamber, an ink container 53 which is composed of a wall (inside wall) 54 having an inside surface equal or similar to an inside surface of the cabinet and functions to internally accommodate ink, and an ink outlet port 52 which is connected to the vapor-liquid exchange path 14 of the negative pressure producing member chamber 10 to lead the liquid from the liquid container 53 to the negative pressure producing member chamber 10. In this embodiment, a sealing member (not shown) such as an O-ring, for example, is disposed in a connector between the ink outlet port 52 and the vapor-liquid exchange path 14 to prevent leakage of ink and introduction of atmosphere through the connector. The sealing member may be disposed on either side of the ink container chamber and the negative pressure producing member chamber or on both sides to enhance a sealing property. Furthermore, the sealing member may be disposed independently of the ink container chamber and the negative pressure producing member chamber and fitted into the connector between the chambers at a coupling stage. The inside wall 54 has flexibility and the ink container 53 is deformable as the internally accommodated ink is discharged. Furthermore, the inside wall 54 has a pinch-off section 56 in which the inside wall is supported in a condition engaged with an outside wall. Furthermore, an external air communicating port 55 is formed in the outside wall so that atmosphere can be introduced between the inside wall and the outside wall.

In sectional views including FIG. 1B which are used for description made below, regions of the negative pressure producing member which hold the ink are traced as slashed regions. Furthermore, ink accommodated in spaces such as the ink container, the atmosphere inlet groove and the vapor-liquid exchange path is traced as a mesh region.

The ink container chamber used in this embodiment is configured by six planar surfaces which compose an approximate form of a rectangular parallelepiped, the cylindrical ink outlet port 52 is added as a curved surface and a surface having a maximum area of the rectangular parallelepiped is indirectly traced in FIG. 1A. Portions forming vertices of the inside wall 54 (vertices including those forming slightly curved surfaces will hereinafter referred to as angles) are thinner than center regions of the surfaces of the parallelepiped and thickness is gradually reduced in directions from the center regions toward the angles so as to form shapes of convexities inside the ink container. These directions are the same as directions of deformation of the surfaces to provide an effect to accelerate deformation described later.

The angle of the inside wall is composed of three surfaces, thereby providing a result that strength of the angle as a whole is relatively high as compared with that of the center region. Furthermore, the angle is thinner than the center region in a direction along extension of the surface, thereby allowing a shift of the surface described later. It is desirable that portions which compose the angle have substantially equal thickness.

Though the outside wall 51 and the inside wall 54 of the ink container chamber are traced in a positional relation as if these walls are separated by a space in FIG. 1B which is a schematic diagram, it is sufficient that these walls are actually separable from each other and the inside wall may be in contact with the outside wall or separated by a slight space.

The above described ink tank is configured so that the ink container chamber is exchangeable for the negative pressure producing member chamber. Using FIGS. 2A1, 2A2, 2B1, 2B2, 2C1 and 2C2, description will therefore be made first of conditions of these chambers when the ink container chamber is connected to the negative pressure producing member chamber. FIGS. 2A1, 2A2, 2B1, 2B2, 2C1 and 2C2 are schematic diagrams descriptive of an example of changes of the chambers during a connecting operation to connect the ink container chamber of the ink tank shown in FIGS. 1A and 1B to the negative pressure producing member chamber in an order from FIGS. 2A1 to 2C2, and a suffix 1 represents a sectional view taken along a section which is the same as that of FIG. 1B and a suffix 2 designates a sectional view taken along an A—A line of a liquid container chamber in FIG. 1B.

FIGS. 2A1 and 2A2 are diagrams descriptive of the negative pressure producing member chamber and the ink container chamber before connection. At this time, sealing means 57 (for example, a film) is disposed in the ink outlet port 52 of the liquid container chamber 50 to prevent the ink accommodated in the ink container from being discharged and the ink container in the liquid container chamber is kept in a condition sealed from atmosphere. Furthermore, the inside wall 54 composing the ink container is formed along the inside surface of the cabinet (outside wall) 51 so as to locate at least the angles of the inside wall at the angles of the outside wall. (This condition is referred to as an "initial condition".) By accommodating the ink in an amount slightly smaller than an amount of ink which can be accommodated in the ink container in this condition so that the ink outlet port is placed at a slightly negative pressure when the sealing means is opened, it is possible to more securely prevent the ink from leaking outside due to external forces, temperature changes and gas pressure changes when the sealing means is opened.

From viewpoints of such environmental changes, it is also desirable that an extremely small amount of air is contained in the ink container before it is connected to the negative pressure producing member chamber. For reducing an amount of air contained in the ink container, a liquid injection method such as that disclosed by Japanese Patent Application Laid-Open No. 10-175311, for example, may be used.

In FIG. 2A1, on the other hand, the negative pressure producing member in the negative pressure producing member chamber holds the ink in its portion. In FIG. 2A1 where an interface of the ink contained in the negative pressure producing member is lower than the atmosphere inlet groove, the atmosphere inlet groove is communicated with atmosphere by way of the negative pressure producing member.

Since an amount of the ink to be contained in the negative pressure producing member is dependent on an amount of the ink which is contained in the negative pressure producing member at a time of ink container chamber exchange described later, the amount of the ink contained in the negative pressure producing member may be more or less variable and the negative pressure producing member may not always hold the ink in a uniform condition as shown in FIG. 2A1. Furthermore, the atmosphere inlet groove and the vapor-liquid exchange path may not always be filled with the liquid but contain air as shown in FIG. 2A1.

Then, the ink container chamber is connected to the negative pressure producing member chamber as shown in FIGS. 2B1 and 2B2. At this time, the ink moves as indicated by an arrow in FIG. 2B1 until a pressure in the negative pressure producing member chamber is equal to that in the ink container chamber, and an equilibrium condition is entered with a negative pressure obtained in the ink supply port 12 as shown in FIGS. 2C1 and 2C2. (This condition is referred to as an operation start condition.) Description will be made in detail of ink movement to obtain this equilibrium condition.

By inserting the vapor-liquid exchange path 14 of the negative pressure producing member chamber into the ink outlet port 52 of the ink container chamber as shown in FIG. 2B1, sealing by the sealing means 57 is released. Since the connector is sealed by the above described sealing means at this time, the ink cannot leak from the connector and external air cannot enter directly the ink container chamber from the connector, whereby the ink container is set in a substantially sealed condition except the vapor-liquid exchange path 14. The ink in the ink container 53 therefore flow into the vapor-liquid exchange path 14 and forms an ink path between the negative pressure producing member 13 of the negative pressure producing member chamber and the ink container 53. When the ink path is formed, the negative pressure producing member starts moving the ink from the ink container to the negative pressure producing member with a capillary force as shown in FIG. 2B1, thereby enhancing the interface in the negative pressure producing member. Furthermore, the inside wall 54 is going to be deformed from a center of the surface which has the maximum area in a direction to reduce a volume of the ink container 53.

Since the outside wall 51 functions to restrict displacement of the angles of the inside wall 54, an action force for deformation by ink consumption and an action force to return to an initial state (FIGS. 2A1 and 2A2) are exerted to the ink container, thereby producing a negative pressure matched with a degree of deformation with no abrupt change. Since a space between the inside wall and the outside wall is communicated with external air by way of the external air communicating port 55, air is introduced between the inside wall 54 and the outside wall 51 as the ink container is deformed as described above.

Even when air exists in the vapor-liquid exchange path 14 in FIG. 2A1, air can easily move into the ink container 53 since the ink container is deformed as the ink is discharged once the ink path is formed by the ink which comes into contact with the negative pressure producing member from the ink container.

Speaking of ink introduction into the atmosphere inlet groove, the ink is introduced when a capillary force of the atmosphere inlet groove is stronger than the negative pressure produced by the ink container like the present embodiment.

As the ink is charged into the negative pressure producing member after the ink starts moving, the ink is filled above a top end of the atmosphere inlet groove as shown in FIG. 2C1 and the atmosphere inlet groove is not communicated with atmosphere. Then, the ink container chamber exchanges the ink with atmosphere by way of the negative pressure producing member chamber only, whereby the ink further moves to equalize a static negative pressure in the vapor-liquid exchange path of the ink container chamber to a static negative pressure in the vapor-liquid exchange path of the negative pressure producing member chamber. In the case shown in FIG. 2C1 where a negative pressure in the negative pressure producing member chamber is higher than a negative pressure in the ink container chamber when the atmosphere inlet groove is not communicated with atmosphere, the ink further moves from the ink container chamber into the negative pressure producing member chamber until both the negative pressures are equal and the negative pressure producing member in the negative pressure producing member chamber holds a larger amount of ink as the ink moves.

When the ink container chamber is connected to the negative pressure producing member chamber, the ink moves from the ink container chamber into the negative pressure producing member chamber without introducing air into the ink container chamber by way of the negative pressure producing member as described above. The static negative pressure in each chamber in the equilibrium condition is to be set at an adequate value ($\alpha$ in FIG. 6) dependently on a kind of liquid discharge recording means to be connected so that the ink will not leak from liquid discharge recording means (not shown) such as a recording head to be connected to the ink supply port.

A lower limit of an amount of the ink movable from the ink container is an amount of the ink to fill the negative pressure producing member to an upper limit level (vapor-liquid interface described later) of the atmosphere inlet groove and an upper limit is an amount of the ink to completely fill the negative pressure producing member. By determining an amount of the ink which moves into the negative pressure producing member from the amounts of the ink corresponding to these upper and lower limits after taking it into consideration that the amount of the ink which is held by the negative pressure producing member before connection is variable, it is therefore possible to adequately select a material and thickness of the ink container matched with the negative pressure producing member on the basis of the amount of the ink and the value $\alpha$ of the negative pressure in the equilibrium condition.

Since the amount of the ink which is held by the negative pressure producing member before connection is variable, there may remain a region of the negative pressure producing member which is not filled with the ink even in the equilibrium condition as shown in FIGS. 2C1 and 2C2. This region can be utilized together with the buffer member as a buffer region for a change due to temperature or pressure to be described later.

When a pressure may be positive in the ink supply port in the equilibrium condition due to the variable amount of the ink, in contrast, the pressure may be adjusted by flowing out some ink with a sucking restoration by using sucking restoration means which is disposed on a liquid discharge recorder main body as described later.

Figure 26:
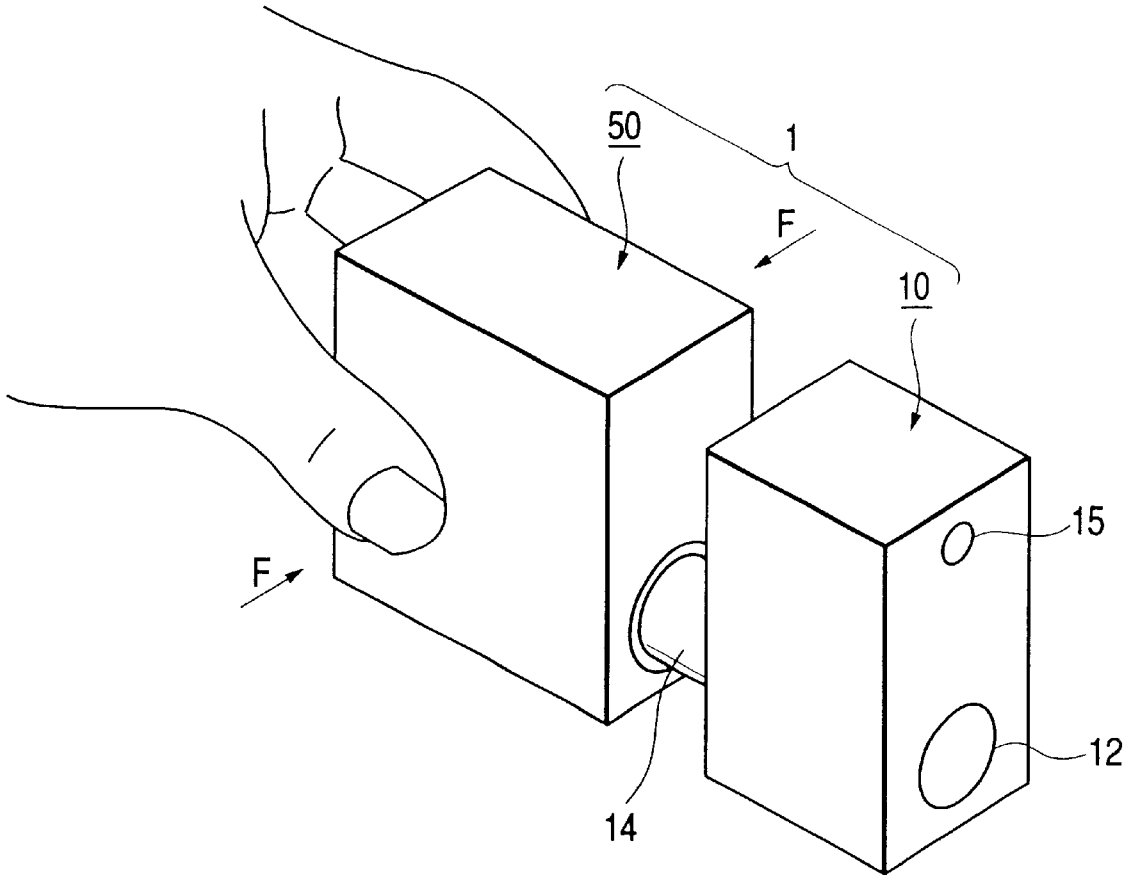
FIG. 26 is a diagram showing an example of recovering method for the liquid supply system according to the present invention.

Furthermore, at the connection time, the ink path may be formed in the vapor-liquid exchange path utilizing an impact which is caused by applying a pressure to the ink container as shown in FIG. 26, for example, pressing the ink container together with the cabinet at the connection time. Furthermore, it is possible to accelerate movement of the gas in the vapor-liquid exchange path into the ink container utilizing the deformation of the ink container due to a pressure change by setting the ink container at a slightly negative pressure before the connection and communicating the ink container with atmosphere by way of the atmosphere inlet groove at the connection time. Though such an impact may cause a portion of air in the path to move into the ink container dependently on a form of the vapor-liquid exchange path and air which may exist in the path before the connection, the present invention allows such a small amount of air to move into the ink container.

Figure 6:
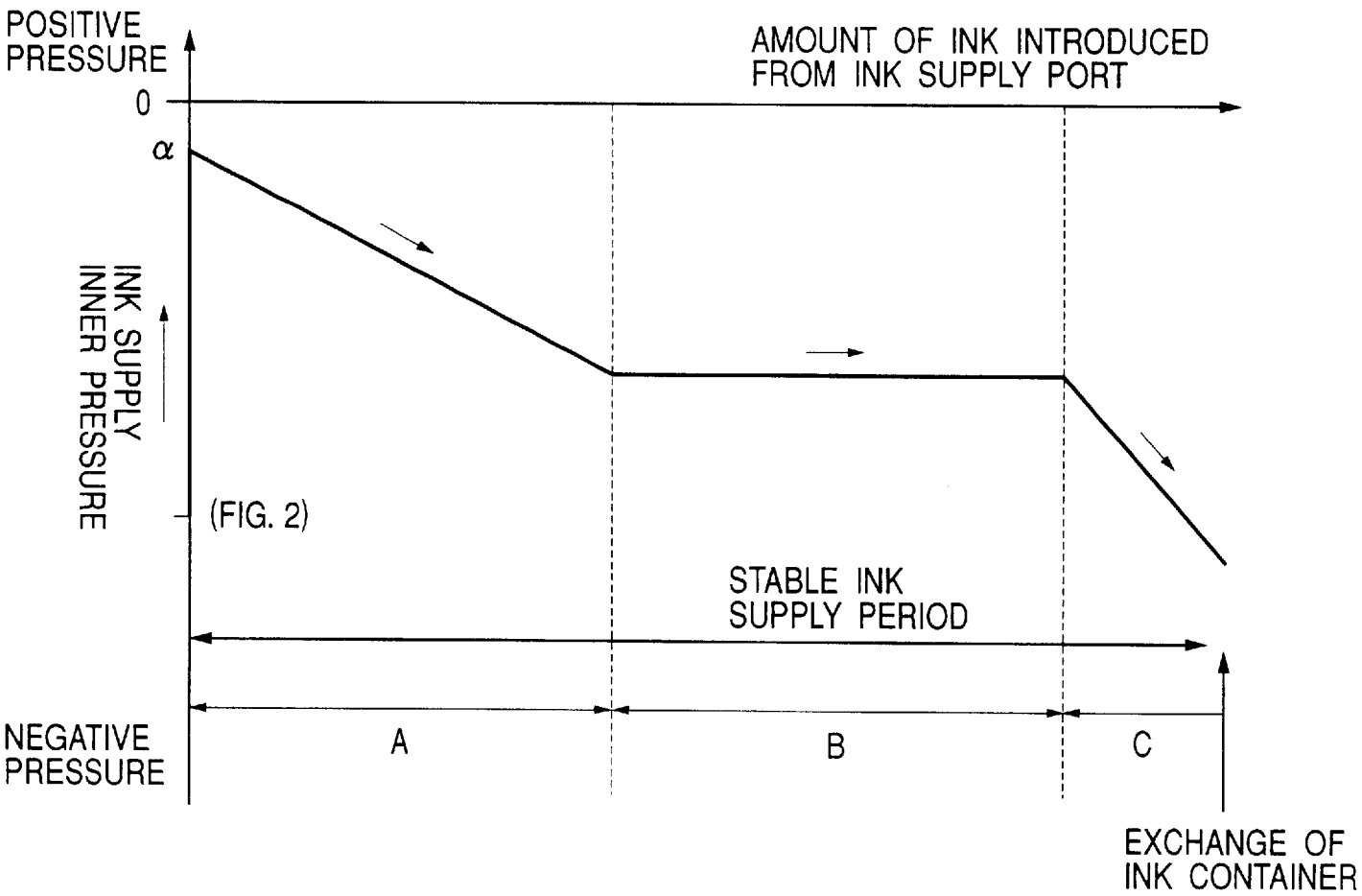
FIG. 6 is a diagram descriptive of relationship of an amount of ink discharged from the ink tank shown in FIGS. 1A and 1B versus a static negative pressure in an ink supply port.

Using FIGS. 3A1, 3A2, 3B1, 3B2, 3C1, 3C2, 4A1, 4A2, 4B1, 4B2, 4C1, 4C2, 5A1, 5A2, 5B1, 5B2, 5C1, 5C2 and 6, description will be made of an example of a condition of the ink tank when the liquid is consumed from a recording head connected to the ink tank in the operation start condition shown in FIGS. 2C1 and 2C2. FIGS. 3A1, 3A2, 3B1, 3B2, 3C1, 3C2, 4A1, 4A2, 4B1, 4B2, 4C1, 4C2, 5A1, 5A2, 5B1, 5B2, 5C1 and 5C2 are schematic diagrams descriptive of an example of changes of the ink container chamber and the negative pressure producing member chamber which are caused by consuming the liquid in the ink tank in an order of FIGS. 3A1, 3A2, 3B1, 3B2, 3C1, 3C2, 4A1, 4A2, 4B1, 4B2, 4C1, 4C2, 5A1, 5A2, 5B1, 5B2, 5C1 and 5C2, a suffix 1 represents a sectional views taken along a section which is the same as that of FIG. 1B and a suffix 2 designates sectional views taken along an A—A line of a liquid container chamber in FIG. 1B. Furthermore, FIG. 6 is a schematic diagram descriptive of relationship between an amount of ink introduced from the ink tank shown in FIGS. 1A and 1B versus a negative pressure in the ink supply port, an abscissa represents an amount of the ink discharged from the ink supply port to the outside and an ordinate designates the negative pressure (static negative pressure) in the ink supply port. Conditions of the changes of the negative pressure shown in FIGS. 2A1, 2A2, 2B1, 2B2, 2C1, 2C2, 3A1, 3A2, 3B1, 3B2, 3C1, 3C2, 4A1, 4A2, 4B1, 4B2, 4C1, 4C2, 5A1, 5A2, 5B1, 5B2, 5C1 and 5C2 are indicated by arrows in FIG. 6.

In case of the ink tank used in this embodiment, the ink supply operations can roughly be classified into those before the vapor-liquid exchange operation shown in FIGS. 3A1, 3A2, 3B1, 3B2, 3C1 and 3C2, those during the vapor-liquid exchange operation shown in FIGS. 4A1, 4A2, 4B1, 4B2, 4C1 and 4C2, and those after the vapor-liquid exchange operations shown in FIGS. 5A1, 5A2, 5B1, 5B2, 5C1 and 5C2. Then, the respective operations will be described in detail below with reference to the drawings.

(1) Operations Before Vapor-liquid Exchange Operation

FIGS. 3A1 and 3A2 show a condition where the ink tank is attached to the recording head in the operation start condition. In this operation start condition, the static negative pressure in the vapor-liquid exchange path of the ink container chamber is equal to the static negative pressure in the vapor-liquid exchange path of the negative pressure producing member chamber. In the case where the ink container chamber is of the exchangeable type as shown in FIGS. 1A and 1B, the ink container is mostly deformed slightly inward as described above when the ink container chamber is exchanged after the ink tank is used until a condition shown in FIG. 2A1 is obtained (detailed later with reference to FIG. 6).

When the recording head 60 starts consuming the ink of the ink tank from the ink supply port 12, the ink held by both the ink container and the negative pressure producing member is consumed while balancing static negative pressures produced by both the ink container and the negative pressure producing member in a direction to increase values of the pressure as shown in FIGS. 3B1 and 3B2. (This condition is referred to as a first ink supply condition.)

Operations in this case are performed, for example, so as to lower a liquid level in the negative pressure producing member in the negative pressure producing member chamber and further deform the ink container as the ink is consumed from the ink supply port, and maintain stable inward collapse of the center portions of the ink container.

In case of this embodiment, the ink container is configured so that a portion without any pinch-off section of a surface adjacent to the surface having the maximum area starts deforming and is apart from the outside wall earlier than a region having a pinch-off section 56 to balance the negative pressures between the ink container and the negative pressure producing member. The pinch-off section 56 is one of parts which restrict the deformation of the inside wall 54. Since the surfaces which have the maximum area and are opposed to each other are deformed almost simultaneously as the ink is discharged as described above, this embodiment deforms the ink container more stably.

Such a first ink supply condition continues until a condition is entered that air enters the ink container by way of the vapor-liquid exchange path as shown in FIGS. 3C1 and 3C2. From the condition shown in FIGS. 3A1 and 3A2 to a condition shown in FIGS. 3C1 and 3C2, the static negative pressure changes relatively to a discharged amount of the ink from the ink supply port so as to be higher little by little nearly in proportion to a discharged amount of the ink as a schematically represented by a region A in FIG. 6.

While the conditions have been described above as an example, more concrete operations will be explained later.

(2) Operations During the Vapor-liquid Exchange Operation

When the ink is further discharged from the ink supply port, gas is introduced into the ink container as shown in FIGS. 3C1 and 3C2. (This condition will hereinafter be referred to as a vapor-liquid exchange condition or a second ink supply condition.) In the vapor-liquid exchange condition, a liquid level in the negative pressure producing member is nearly constant at the upper end of the atmosphere inlet groove (vapor-liquid interface) as shown in FIGS. 4A1, 4A2, 4B1 and 4B2. Since air is introduced into the ink container chamber by way of the atmosphere inlet groove 17 and the vapor-liquid exchange path 14 through the atmosphere communicating port 15 dependently on a consumed amount of the ink as the recording head consumes the ink, whereby the ink is replenished from the ink container chamber into the negative pressure producing member in the negative pressure producing member chamber by way of the vapor-liquid exchange path. On the other hand, the ink container introduces air as the ink is discharged to maintain balance of the negative pressure with the negative pressure producing member by its deformed condition, thereby almost maintaining the form during the vapor-liquid exchange operation.

Accordingly, a change of the static negative pressure relative to a discharged amount of the ink from the ink supply port is kept at a nearly constant value in the vapor-liquid exchange condition as schematically represented by a region B in FIG. 6, thereby stabilizing ink supply to the liquid discharge recording means.

However, FIG. 6 is a schematic diagram and the negative pressure varies even in vapor-liquid exchange regions. Since the ink container chamber itself can produce a negative pressure by the deformation of the ink container in the ink tank according to the present invention, a time difference may be often produced between discharge of the liquid from the ink container and introduction of air by way of the vapor-liquid exchange path as described later when the ink is continuously discharged in the vapor-liquid exchange condition. This time difference can be a cause for a change of the negative pressure but such a change is within a range allowable for use as an ink-jet recorder.

In the case where a vapor-liquid exchange path has a certain length as in the embodiment, air bubbles may be accumulated in the vapor-liquid exchange path dependently on a kind of ink used and the air bubbles may move into an ink container in a certain large amount. Though the air bubbles may cause a change of a negative pressure during moving, such a change is allowable for use as an ink-jet recorder and included in the vapor-liquid exchange condition in the liquid supply system according to the present invention.

In the case where air bubbles are apt to remain in the vapor-liquid exchange path as described above, the air bubbles may temporarily choke the vapor-liquid exchange path even while a liquid level of the ink in the ink container is lower than the top end of the vapor-liquid exchange path a shown in FIGS. 4C1 and 4C2. If the air bubbles disappear and the ink container is temporarily communicated completely with atmosphere in such a condition, the ink container is deformed in a direction to return to a form in an initial condition slightly from in the vapor-liquid exchange condition shown in FIGS. 4B1 and 4B2. When the vapor-liquid exchange path is choked by the air bubbles, however, the liquid supply system may carry out an operation similar to that in the vapor-liquid exchange condition which moves ink from the ink container into the negative pressure producing member chamber without feeding new bubbles into the vapor-liquid exchange path. Accordingly, the condition shown in FIGS. 4C1 and 4C2 is included in the vapor-liquid exchange condition in the liquid tank according to the present invention so far as a difference between a negative pressure in the ink tank in this condition and a negative pressure in another condition shown in FIGS. 4A1, 4A2, 4B1 and 4B2 is within a practically negligible range.

Though description has been made above of the vapor-liquid exchange operation of the ink tank according to the present invention, these operations are not all operations which are performed during the vapor-liquid exchange by the ink tank according to the present invention which has the deformable ink container chamber.

In case of an ink tank having a conventional ink container chamber which is not deformable, ink is supplied to a negative pressure producing member immediately after introducing atmosphere into the ink container chamber.

In case of the ink tank having the ink container chamber which is deformable according to the present invention, in contrast, ink may be supplied to the negative pressure producing member without introducing atmosphere into the ink container chamber. In contrast, the ink may not be introduced immediately after atmosphere is introduced into the ink container chamber as the ink is consumed. The ink may or may not be supplied dependently on balance between displacement of the ink container chamber and a negative pressure in the negative pressure producing member chamber.

Though a concrete example of operations will be described later, the ink tank having the above described configuration may perform the vapor-liquid exchange operations different (in a timing) from those of an ink tank having the conventional configuration, thereby being capable of exhibiting a buffer effect for external causes such as abrupt ink consumption, environmental changes and vibrations, for example, owing to a time deviation between ink discharge from the ink container and gas introduction into the ink container, and enhancing reliability of stable ink supply owing to a timing deviation.

(3) Operations After Vapor-liquid Exchange

When the ink is further discharged from the ink supply port, a liquid level of the ink in the ink container is lower than the top end of the atmosphere inlet groove as shown in FIGS. 5A1 and 5A2 and the ink container is completely communicated with atmosphere by way of the vapor-liquid exchange path. Since the ink container is communicated with atmosphere at this time, the ink container is deformed in a direction to return to the form in the initial condition from the form in the vapor-liquid exchange condition. Even when an interior of the ink container is set at atmospheric pressure, however, the ink container does not resume an initial form completely, but maintains a slightly deformed condition.

In this embodiment wherein the vapor-liquid exchange path has the large diameter, some ink remaining in the ink container may be absorbed by the negative pressure producing member, thereby enhancing the liquid level in the negative pressure producing member and temporarily enhancing the negative pressure. When the vapor-liquid exchange path is sealed from atmosphere due to the ink in the negative pressure producing member thereafter, ink may be consumed as if it were consumed by the above described vapor-liquid exchange operation.

Though description is made above of the operation which sets the interior of the ink container chamber at the atmospheric pressure when the liquid level in the negative pressure producing member is lower than the top end of the atmosphere inlet groove, it is an example of operation of the ink tank according to the present invention and other operations will be described later in detail.

After the ink in the ink container has been consumed almost completely as described above, the ink remaining in the negative pressure producing member chamber is consumed as shown in FIGS. 5B1, 5B2, 5C1 and 5C2. Though the ink in the ink container chamber is ordinarily absorbed completely into the negative pressure producing member due to vibrations at a carriages canning time when disposing an ink tank on a carriage, it is preferable to dispose the ink container chamber, for example, obliquely so that a side of the supply port is located lower in a direction of gravity.

A change of the negative pressure relative to an amount of the ink discharged from the ink supply port in the condition after the vapor-liquid exchange operation described above has a form to enhance the negative pressure in proportion to the amount of the ink introduced from the ink supply port as schematically represented by a region C in FIG. 6. Since a fear of ink leakage from the vapor-liquid exchange path 14 and the ink outlet port 52 is low once such a condition is obtained, the ink container chamber is to be detached and a new ink container chamber is to be prepared for exchange as shown in FIGS. 2A1 and 2A2.

Even when the ink is consumed further from a condition shown in FIGS. 5C1 and 5C2 until the negative pressure producing member in the vicinity of the vapor-liquid exchange path does not hold the ink any longer, the ink can be charged securely into the negative pressure producing member in the vapor-liquid exchange path which constitutes an ink supply path since the ink container is deformed as the ink is discharged once an ink path is formed by the exchange operation described above.

The liquid supply operations of the ink tank in the embodiment shown in FIGS. 1A and 1B are as outlined above.

In an example of ink consumption operations described above, the ink moves until a pressure in the negative pressure producing member chamber is equal to a pressure in the ink container chamber and the operation start condition is set after the ink container chamber is connected to the negative pressure producing member chamber, and then the ink held in both the ink container and the negative pressure producing member is consumed while balancing the static negative pressures produced in the ink container and the negative pressure producing member in a direction to enhance values of the static pressures after the liquid discharge recording means starts consuming the ink. Then, the ink remaining in the negative pressure producing member chamber is consumed after the vapor-liquid exchange condition where a nearly constant negative pressure is maintained relative to ink discharge while holding the vapor-liquid interface in the negative pressure producing member by introducing a gas into the ink container.

Since the ink tank according to the present invention has a step of using the ink in the ink container without introducing any external air into the ink container as described above, it is sufficient to consider only air which is introduced into the ink container at a coupling time as a factor to restrict an internal volume of a liquid container vessel in the ink supply process (a first ink supply condition). As a result, the ink tank provides a merit that the ink tank can cope with environmental changes even when a restriction on an internal volume of the ink container chamber is moderated.

Since the ink tank according to the present invention which has the configuration described above is capable of carrying out the vapor-liquid exchange operation at the timing different from that of an ink tank which has the conventional configuration and makes it possible to supply ink in a condition other than a condition of ordinary use.

Furthermore, the ink tank according to the present invention not only permits consuming the ink in the ink container chamber almost completely but also allows air to be contained in the vapor-liquid exchange path at an exchange time and enables exchanging the ink container chamber regardless of an amount of ink held in the negative pressure producing member, thereby making it possible to provide an ink supply system which permits exchanging an ink container chamber without disposing a residual amount detecting mechanism by the conventional art.

In order to enhance a negative pressure in proportion to a discharge amount of ink (region A), then maintain the negative pressure at a definite value (region B) and enhance the negative pressure in proportion to the discharge amount of the ink thereafter (region C) as shown in FIG. 6, it is desirable to introduce atmosphere, that is, to shift the region A to the region B before the deformable surfaces of the ink container are brought into contact with each other. This is because the negative pressure in the ink container chamber is varied relative to the discharge amount of the ink at different ratios before and after the opposed surfaces having the maximum area are brought into contact with each other.

An ink capability of the ink tank was evaluated in the first embodiment described above. A negative pressure producing member having a pore size of approximately 60 pieces/inch was accommodated in a negative pressure producing member chamber having inside dimensions of approximately 48 mm×46 mm×10 mm and a hollow pipe having an inside diameter of approximately 7 mm was used as a vapor-liquid exchange path. A negative pressure characteristic which was similar to that shown in the schematic diagram in FIG. 6 was obtained when an ink container chamber which had an outside wall of a shock resistance polystyrene (HIPS) resin having maximum thickness of approximately 1 mm, an inside wall of high density polyethylene (HDPE) resin having maximum thickness of approximately 150 $\mu$m and a volume of approximately 30 $cm^3$ was connected to the negative pressure producing member chamber and ink was sucked from an ink supply port of the negative pressure producing member chamber. At this time, a static negative pressure in a stable ink supply period indicated by B in FIG. 6 was approximately-110 mmAq.

Figure 7A:
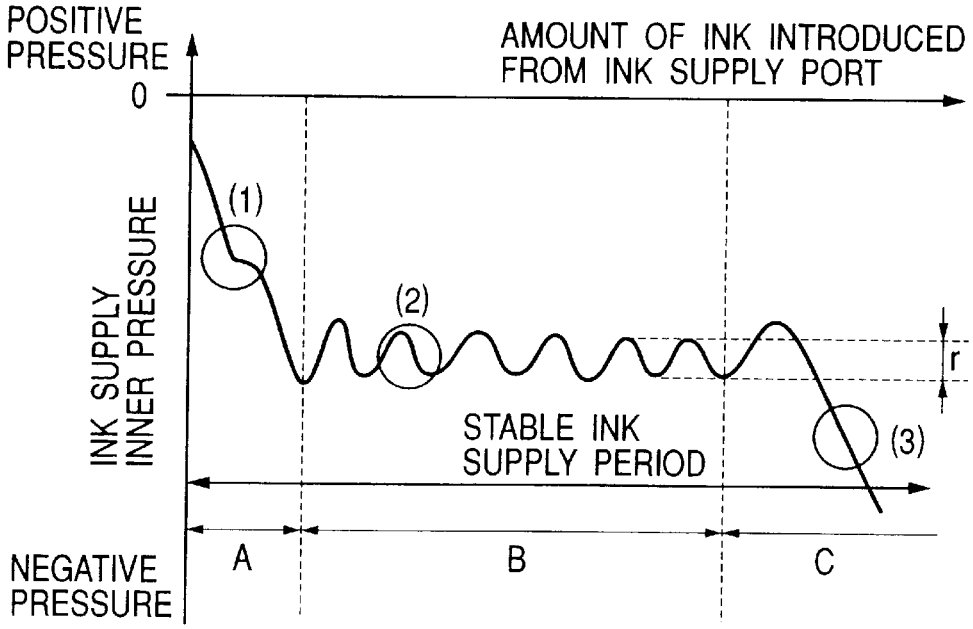
FIG. 7A is a diagram descriptive in detail of a negative pressure curve shown in FIG. 6 and FIG. 7B a diagram descriptive of changes with time in an amount of ink discharged from an ink container and an amount of air introduced into the ink container which are caused by discharging liquid continuously.

Furthermore, a measurement of a variation of a static negative pressure relative to discharge amounts of ink provided a curve shown in FIG. 7A. Knowledge related to details of the ink supply operations which is described below was obtained by varying a material and thickness of the inside wall of the ink container as well as a capillary force generated by the negative pressure producing member.

Figure 8:
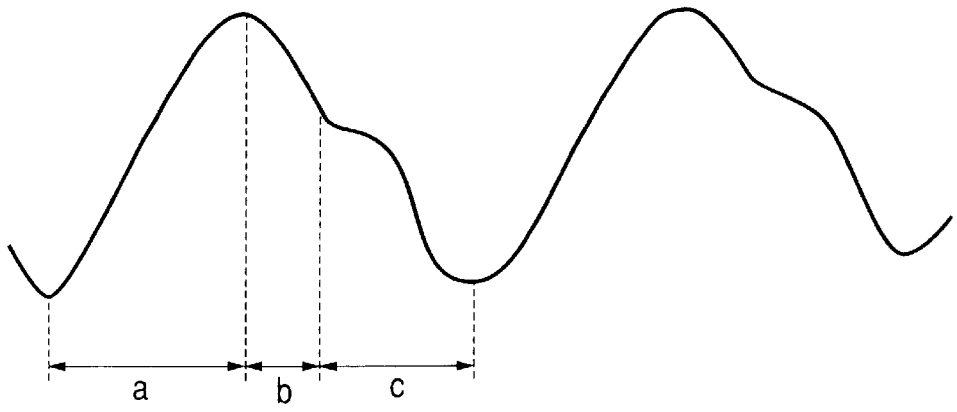
FIG. 8 is a detailed diagram descriptive of a region A shown in FIG. 7A.
Figure 10:
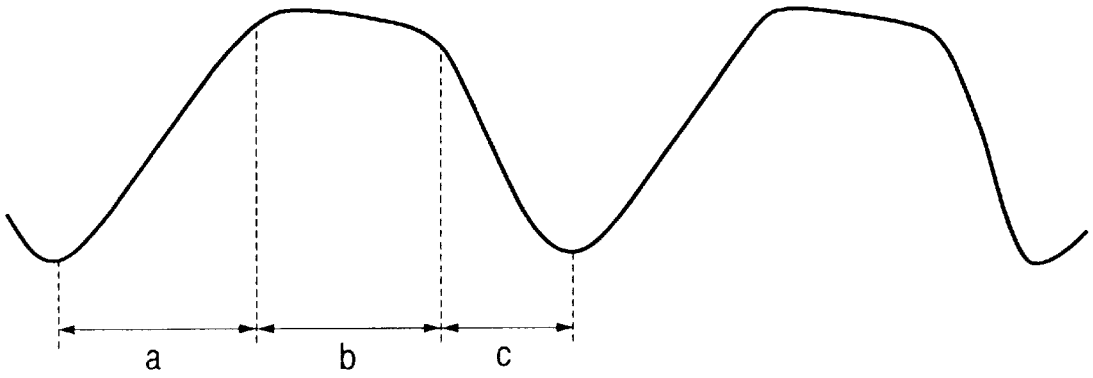
FIG. 10 is a diagram descriptive in detail of a region B shown in FIG. 7A.

A diagram descriptive in detail of an actual example of the negative pressure curve shown in FIG. 6 is provided in FIG. 7A, in which (1), (2) and (3) correspond to (1), (2) and (3) in description above of the operations. Furthermore, FIG. 8 is a diagram descriptive in more detail of an example of a region A in FIG. 7A, FIGS. 9A1, 9A2, 9B1, 9B2, 9C1 and 9C2 are diagrams showing operations of the ink tank in the region A in FIG. 7A in an order from A to C, FIG. 10 is a diagram illustrative in more detail of a region B in FIG. 7A, and FIGS. 11A1, 11A2, 11B1, 11B2, 11C1 and 11C2 are diagrams illustrative of the operations of the ink tank in the region B in FIG. 7A in the order from A to C. In FIGS. 9A1, 9A2, 9B1, 9B2, 9C1, 9C2, 11A1, 11A2, 11B1, 11B2, 11C1 and 11C2, a suffix 1 represents a sectional view taken along a section which is the same as that in FIG. 1B and a suffix 2 designates a sectional view taken along the A—A line of the liquid container vessel shown in FIG. 1B. In diagrams used for description, deformation of the ink container chamber or the like are traced more or less extremely for easier understanding.

(1) Description of Region (1) in FIG. 7A

This region (before the vapor-liquid exchange) will be described in three patterns. Individual patterns are included in the present invention and variable dependently on conditions such as a capillary force of the negative pressure producing member, thickness and material of the ink container chamber, and balance among the patterns.

<First Pattern of Region (1) in FIG. 7A>

This pattern is generally produced when negative pressure control is governed by the ink container chamber rather than the negative pressure producing member. Speaking concretely, the pattern is often produced when the ink container chamber is relatively thick or when the ink container chamber has a rigidity which is relatively high.

In the initial condition, the ink is discharged first from the negative pressure producing member. This is because resistance to the ink discharged from the negative pressure producing member is lower than resistance to the ink discharged from the ink container chamber. After the ink is discharged first from the negative pressure producing member as described above, the ink is discharged from the negative pressure producing member and the ink container chamber respectively while balancing the negative pressure producing member with the ink container chamber. The ink is discharged from the ink container chamber while deforming the inside wall inward.

<Second Pattern of Region (1) in FIG. 7A>

In contrast to the first pattern described above, the second pattern is produced when the negative pressure is governed by the negative pressure producing member rather than the ink container chamber. The second pattern is often produced when the inside wall of the ink container chamber is relatively thin or has a relatively low rigidity.

In the initial condition, the ink is discharged first from the ink container chamber. This is because resistance to the ink discharged from the ink container chamber is lower than resistance to the ink discharged from the negative pressure producing member. Then, the ink is discharged from the negative pressure producing member and the ink container chamber respectively while balancing the negative pressure producing member with the ink container chamber as described above.

<Third Pattern of Region (1) in FIG. 7A>

A third pattern is often produced when the negative pressure control is governed nearly equally by the negative pressure producing member and the ink container chamber.

In this case, the ink is discharged in the initial condition from the negative pressure producing member and the ink container chamber respectively while balancing the negative pressure producing member with the ink container chamber. While balancing as described above, the ink tank proceeds to a vapor-liquid exchange condition described later.

(2) Description of Region (2) in FIG. 7A

Then, description will be made of a vapor-liquid exchange region. This region will be described in two patterns. For description in more detail, an enlarged view of a negative pressure curve in the region (2) in FIG. 7A will be used.

<First Pattern of Region (2) in FIG. 7A>

This pattern is generally produced when the negative pressure control is governed by the ink container chamber rather than the negative pressure producing member. Speaking concretely, this pattern is often produced when the ink container chamber is relatively thick or when the inside wall of the ink container chamber has a relatively high rigidity.

In the vapor-liquid exchange region, atmosphere is introduced from the negative pressure producing member chamber into the ink container chamber (region a in FIG. 8). The ink is introduced to moderate balance of the negative pressures described above. By introducing the ink into the ink container chamber, the inside wall of the ink container chamber is deformed slightly outward as shown in FIGS. 9A1 and 9A2. As air is introduced, the ink is supplied from the ink container chamber into the negative pressure producing member chamber, thereby slightly enhancing a liquid level in the negative pressure producing member chamber (a→b in FIG. 8). When the ink is further discharged from the head, the ink is discharged first from the negative pressure producing member in this example. Accordingly, the liquid level changes downward in the negative pressure producing member chamber as shown in the drawings (region b in FIG. 8) (FIGS. 9B1 and 9B2). After this condition, the ink is discharged from the negative pressure producing member and the ink container chamber respectively while balancing the negative pressure producing member with the ink container chamber. Accordingly, the liquid level is further changes downward in the negative pressure producing member and the inside wall of the ink container chamber is deformed inward (region c in FIG. 8) (FIGS. 9C1 and 9C2). After continuation of this condition, atmosphere is introduced into the ink container chamber by way of an atmosphere inlet path and the region (1) proceeds to a region 2 in FIG. 7A.

<Second Pattern of Region (2) in FIG. 7A>

In contrast to the example described above, a second pattern is produced when the negative pressure control is governed by the negative pressure producing member rather than the ink container chamber. The second pattern is often produced when the inside wall of the ink container chamber is relatively thin or has low rigidity.

In the vapor-liquid exchange region, atmosphere is introduced from the negative pressure producing member chamber into the ink container chamber as described above (region a in FIG. 10). When the ink is introduced into the ink container chamber, the inside wall of the ink container chamber is slightly deformed outward as shown in FIGS. 11A1 and 11A2. As air is introduced, the ink is supplied from the ink container chamber into the negative pressure producing member chamber and the liquid level is slightly enhanced in the negative pressure producing member chamber (a→b in FIG. 10). When the ink is discharged further from the head, the ink is discharged mostly from the ink container chamber in this pattern. In this case, the negative pressure is gently enhanced with no remarkable change due to thickness and a rigidity characteristic of the ink container chamber. As the ink is discharged, the inside wall of the ink container chamber is gradually deformed inward (region b in FIG. 10). In this region, the ink is scarcely discharged from the negative pressure producing member and the liquid level is scarcely changed in the negative pressure producing member.

When the ink is further discharged, the region b shifts to a region c in FIG. 10, where the ink is discharged from the negative pressure producing member and the ink container chamber respectively while balancing the negative pressure producing member with the ink container chamber. In this region, the liquid level in negative producing member is changed downward and the inside wall of the ink container chamber is deformed inward as described above (region c in FIG. 10) (FIGS. 11C1 and 11C2). After continuation of this condition, atmosphere is introduced into the ink container chamber by way of the atmosphere inlet path and the region c shifts again to the region a in FIG. 10.

(3) Description of Region (3) in FIG. 7A

Finally, description will be made of a region (3) in FIG. 7A.

This region is produced when the ink has been discharged in a large amount and the vapor-liquid exchange has been completed, that is, when the ink has been discharged almost from the ink container chamber and the ink is discharged mainly from the negative pressure producing member only. This region will be described below in two patterns.

<First Pattern of Region (3) in FIG. 7A>

In this example, description will be made of a case where an internal pressure of the ink container chamber is set approximately at an atmospheric level after the vapor-liquid exchange region.

In the condition described above where the vapor-liquid exchange has been completed, the ink in the ink container chamber has been almost exhausted. In the condition where the vapor-liquid exchange has been completed, a meniscus is generally formed in the atmosphere communicating path, the communicating path between the negative pressure producing member chamber and the ink container chamber or the negative pressure producing member. However, the meniscus is broken for a cause such as carriage vibrations when the liquid level in the negative pressure producing member is lower than the top end of the atmosphere inlet path. Accordingly, atmosphere is communicated with the ink container chamber by way of the atmosphere communicating path. An interior of the ink container chamber is therefore set approximately at atmospheric pressure. The inside wall of the ink container chamber is displaced inward therefore tends to resume the initial condition by its elasticity. However, the initial condition is not resumed completely in general. This is because the ink container chamber has been subjected to the so-called buckling in most cases after the ink container chamber was deformed inward beyond a certain condition while the ink was discharged from the ink container chamber as described above. Accordingly, the ink container chamber does not resume the initial condition completely in most cases even when the interior of the ink container chamber is set at the atmospheric pressure.

After the interior of the ink container chamber is set at the atmospheric pressure and the inside wall resumes the initial condition, the ink is discharged from the negative pressure producing member and the liquid level is lowered in the negative pressure producing member. Accordingly, the negative pressure is enhanced nearly proportionally.

<Second Pattern of Region (3) in FIG. 7A>

Description will be made of a second pattern in which the interior of the ink container chamber is maintained in a negative pressure condition even when the liquid level in the negative pressure producing member is lower than the top end of the atmosphere inlet path.

The ink container chamber is sealed from atmosphere with the meniscus formed in the atmosphere inlet path, the communicating path or the negative pressure producing member as described above. In this condition, the ink may be consumed and the liquid level is lowered continuously in the negative pressure producing member in a certain case. Accordingly, the ink in the negative pressure producing member is consumed while the inside wall of the ink container chamber are kept deformed inward.

Even in this case, however, the meniscus may be broken due to the cause such as the carriage vibrations or the environmental change during ink consumption and the interior of the ink container chamber may be set approximately at the atmospheric pressure. In such a case, the inside wall of the ink container chamber almost resumes the initial condition.

Pressure variations (amplitude r and a period) during the vapor-liquid exchange which are relatively large as compared with those of a conventional ink tank system which carries out the vapor-liquid exchange as described above is mentioned as a characteristic of a phenomenon of the vapor-liquid exchange occurring in the ink tank according to the present invention having the configuration described above.

A reason of this characteristic is the condition of the inside wall which is deformed inward in the configuration of the ink tank according to the present invention by discharging the ink from the ink container chamber before the vapor-liquid exchange as described with reference to the region (1) shown in FIG. 7A. Accordingly, the elasticity of the inside wall always exerts a force which moves outward the inside wall of the ink container chamber. Air is therefore introduced into the ink container chamber in an amount larger than a predetermined amount in most cases to moderate a pressure difference between the negative pressure producing member and the ink container chamber at a time of the vapor-liquid exchange. The ink is therefore tends to be introduced in a large amount from the ink container chamber into the negative pressure producing member chamber. In the configuration of the conventional system wherein the ink container is not deformed, in contrast, ink is introduced into the negative pressure producing member chamber immediately after a predetermined amount of air is introduced.

When characters are printed in a monochromatic mode, for example, ink is discharged in a large amount at a time from a head. Accordingly, the ink is discharged abruptly also from a tank, but the ink tank according to the present invention which has the above described configuration allows the ink to be discharged by the vapor-liquid exchange in an amount relatively large as compared with a conventional amount, thereby eliminating a fear of ink exhaustion and enhancing a reliability.

Furthermore, the ink tank according the present invention which has the configuration described above allows the ink to be discharged in a condition where the ink container chamber is deformed inward provides a high buffer effect to external causes such as the carriage vibrations and environmental changes.

The above described operations at a series of ink consumption processes will be explained from another viewpoint with reference to FIG. 7B.

Figure 7B:
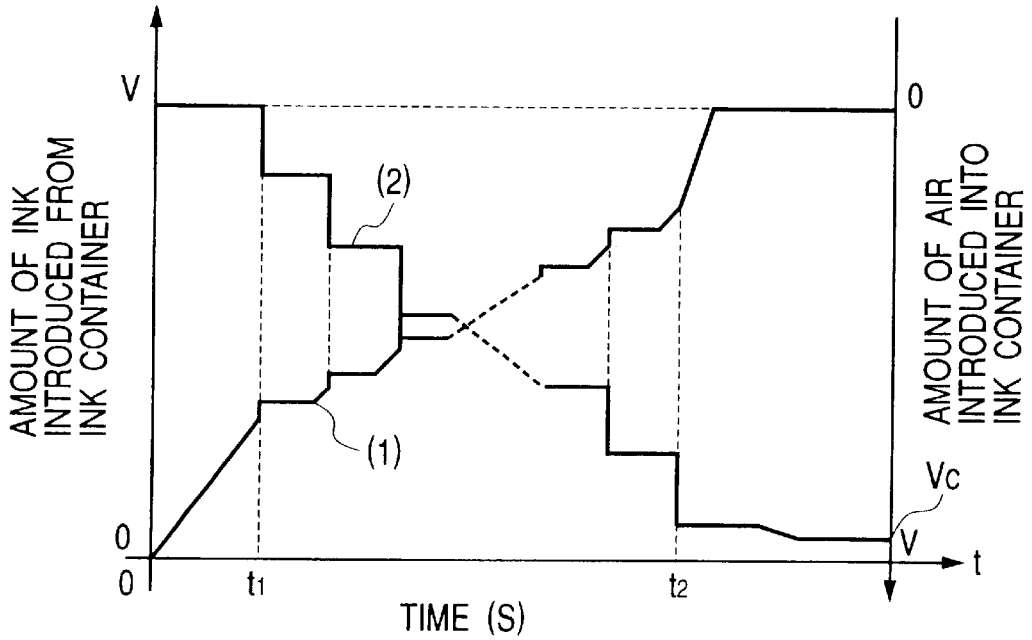

FIG. 7B exemplifies an amount of air introduced into an ink container taking time and amount of the ink introduced from the ink container as an abscissa and an ordinate respectively. An amount of the ink supplied from an ink-jet head is assumed to be constant relative to time lapse.

From the viewpoint described above, the amount of the ink discharged from the ink container is represented by a solid line (1) and the amount of air introduced into the ink container is represented by a solid line (2). A section from t=0 to t=t1 corresponds to the region before the vapor-liquid exchange shown in FIG. 7A. In this region, the ink is introduced from the head while balancing amounts from the negative pressure producing member and the ink container. Introduction patterns are as described above.

Next, a section from t=t1 to t=t2 corresponds to the vapor-liquid exchange region (region B) in FIG. 7A. Vapor-liquid exchange is performed on the basis of the negative pressure balance described above. Air is introduced into the ink container (indicated by a step of the solid line (2), whereby the ink is discharged from the ink container as indicated by the solid line (1) in FIG. 7B. At this time, the ink is discharged from the ink container in an amount equal to an amount of air which is introduced not immediately after air introduction, but is discharged finally in the amount equal to the air which is introduced, for example, after lapse of a predetermined time from the air introduction. As apparent from FIG. 7B, a timing deviation is caused as compared with the operation of the conventional ink tank using the ink container which is not deformed as described above. This operation is repeated in the vapor-liquid exchange region as described above. At a certain point, a volume of air and a volume of the ink are set in a reverse relation in the ink container.

After a point of t=t2, the ink tank enters a vapor-liquid exchange region (region c) shown in FIG. 7A. In this region, the ink container is set approximately at the atmospheric pressure as described above. (The ink container may not be set at the atmospheric pressure dependently on conditions as described above.) Accordingly, the elasticity of the inside wall of the ink container exerts the force to return to the initial condition. However, the so-called buckling does not allow the ink container to return to the initial condition completely as described above. Accordingly, a volume Vc of air finally introduced into the ink container is (V>Vc). In this region also, there is obtained a condition where all the ink discharged from the ink container is consumed completely.

Next, description will be made with reference to FIGS, 12A, 12B and 12C of operations which are carried out when the ink container is exchanged in conditions in the course of ink consumption.

Figure 12A:
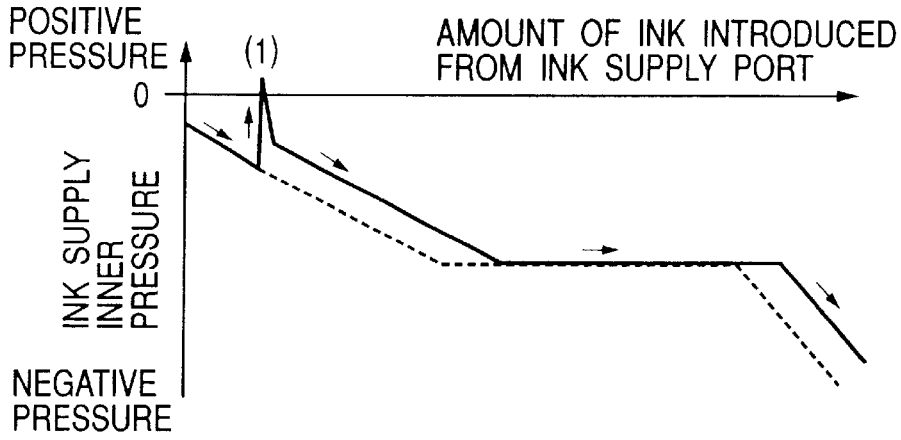
FIGS. 12A, 12B and 12C are diagrams descriptive of operations during exchange of an ink container.

(a) When Ink Tank is Exchanged Before Vapor-liquid Exchange (FIG. 12A)

In the condition before the vapor-liquid exchange, the negative pressure producing member and the ink container chamber are consuming the ink while balancing with each other as described above. In this condition, the negative pressure is enhancing nearly proportionally. Furthermore, the liquid level is located above the top end of the atmosphere inlet path in the negative pressure producing member.

When the ink container chamber is exchanged and a new ink container chamber is mounted in position in this condition, the ink is supplied from the new ink container chamber to the negative pressure producing member since a negative pressure is low or a pressure may be positive in the new ink container at an initial stage, whereby the liquid level is enhanced in the negative pressure producing member and stabilized when negative pressures are balanced between the ink container chamber and the negative pressure producing member. In this case, enhancement of the liquid level does not cause ink leakage from the atmosphere communicating port since the above described buffer region is reserved over the negative pressure producing member.

Though mounting of the ink container chamber may lower the negative. pressure or make it positive in a certain case, the ink tank is capable of forming an adequate negative pressure condition by carrying out an initial recovery at a tank mounting time or the like. The ink is consumed thereafter in the above described consumption pattern.

Even when the negative pressure producing member in the vicinity of the vapor-liquid exchange path of the negative pressure producing member chamber is not filled with the ink, the liquid supply system according to the present invention is capable of moving the ink from the ink container to the negative pressure producing member utilizing the capillary force of the negative pressure producing member chamber so far as the ink path is formed from the ink container to the negative pressure producing member chamber. Accordingly, the ink in the ink container chamber can be used without fail when the ink container chamber is mounted regardless of a condition of the ink held by the negative pressure producing member in the vicinity of the coupling section.

Figure 12B:
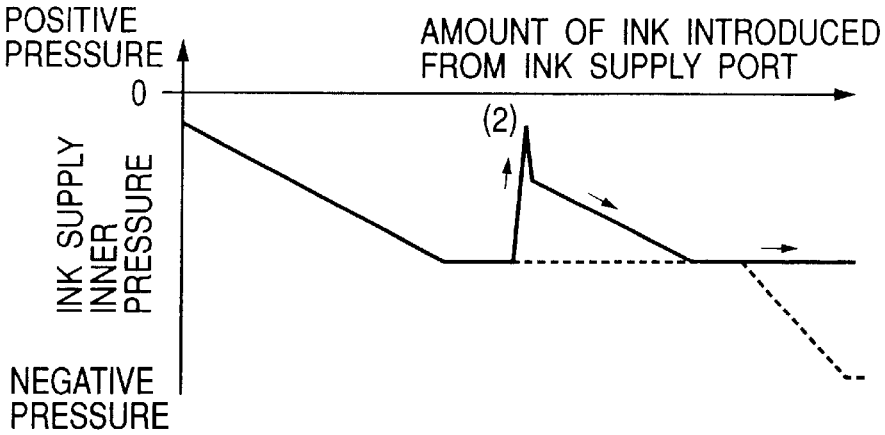

(b) When Ink Tank is Exchanged During Vapor-liquid Exchange (FIG. 12B)

In a condition during the vapor-liquid exchange, the liquid level in the negative pressure producing member is generally stable at the top end of the atmosphere inlet path and the inside wall of the ink container chamber is deformed inward as described above.

When the ink container chamber is detached and a new ink container chamber in the initial condition is mounted, the ink in the ink container chamber is supplied into the negative pressure producing member and the liquid level is enhanced in the negative pressure producing member as described above. Speaking concretely, the liquid level is displaced above the atmosphere inlet path. Accordingly, the inside wall of the ink container chamber is displaced inward and a slight negative pressure condition is set in the tank.

After the liquid level is stabilized, the ink is consumed in the consumption patterns ((1)-1 through (1)-3) described above. The vapor-liquid exchange is carried out when a predetermined negative pressure is reached.

Figure 12C:
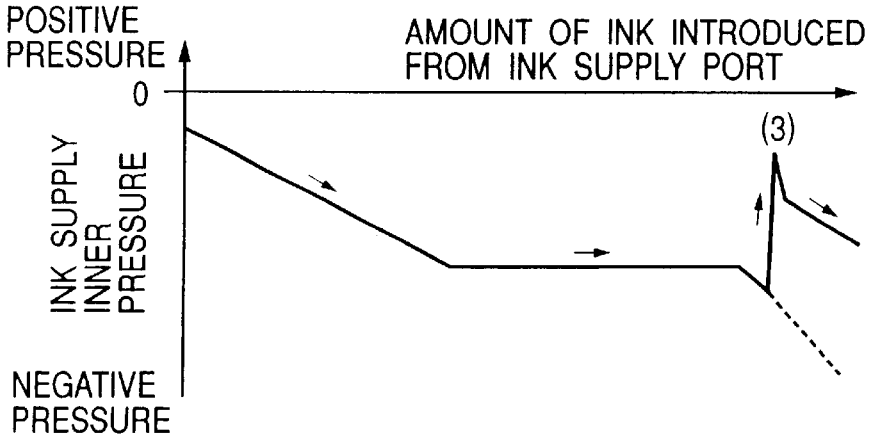

(c) When Ink Tank is Exchanged After Vapor-liquid Exchange (FIG. 12C)

In a condition after the vapor-liquid exchange, the liquid level in the negative pressure producing member is lower than the top end of the atmosphere inlet path as described above and, the ink container chamber is set approximately at the atmospheric pressure or a negative pressure and its inside wall is returned to the initial condition or maintained in a condition deformed inward.

When the ink container chamber is exchanged in this condition also, the ink in the ink container chamber is supplied into the negative pressure producing member and the liquid level is enhanced in the negative pressure producing member. In this case, the liquid level is generally enhanced above the top end of the atmosphere inlet path but may be balanced below the top end of the atmosphere inlet path. The inside wall of the ink container chamber is deformed inward by the introduction of the ink and nearly negative pressure condition is set.

When the liquid level is displaced above the atmosphere inlet path, the vapor-liquid exchange is started after the ink is consumed through the processes described above. When the liquid level is balanced below the atmosphere inlet path, the vapor-liquid exchange is started immediately.

The ink tank according to the present invention is capable of producing a stable negative pressure as described above, thereby carrying out ink supply operations without fail even when the ink container chamber is exchanged at each of the consumption processes (a) through (c).

The ink tank according to the present invention is capable of moderating a slight negative pressure variation with the ink container chamber as described above and the configuration according to the present invention is capable of coping with environmental changes by a solving method different from the conventional method even in a condition where air is contained in the ink container such as the second ink supply condition.

Description will therefore be made with reference to FIGS. 13A1, 13A2, 13B1, 13B2, 13C1, 13C2, 13D1, 13D2 and 14 of a mechanism for stably holding the ink when environmental conditions are changed.

FIGS. 13A1, 13A2, 13B1, 13B2, 13C1, 13C2, 13C1 and 13C2 are diagrams descriptive of a function as a buffer absorber of the negative pressure producing member above the atmosphere inlet groove and a buffer function of the ink container, and showing in an order from A to D changes of the ink tank caused by air in the ink container chamber which is swollen due to a reduction of the atmospheric pressure, a rise of atmospheric temperature and so on from those in a condition (vapor-liquid exchange condition) shown in FIGS. 4A1 and 4A2. A suffix 1 represents a sectional view taken along a section which is the same as that of FIG. 1D and a suffix 2 designates a sectional view taken along the A—A line of the liquid container chamber shown in FIG. 1B.

When the air in the ink container chamber is swollen due to the reduction of the atmospheric pressure (or rise of the atmospheric temperature), wall surfaces (1) composing the ink container and a liquid surface (2) are depressed as shown in FIGS. 13B1 and 13B2, thereby increasing an internal space of the ink container and flowing a portion of the ink from the ink container into the negative pressure producing member chamber by way of the vapor-liquid exchange path. Since the internal space of the ink container is increased, an amount of the ink which flows into the negative pressure producing member (a rise of the liquid level in the negative pressure producing member shown as (3) in FIG. 13C1) is remarkably smaller than that in the case where the ink container cannot be deformed.

When the atmospheric pressure changes abruptly, the amount of the ink which flows through the vapor-liquid exchange path moderates the negative pressure in the ink container and the internal space of the ink container, whereby a force of resistance produced by moderating the inward deformation of the inside wall of the ink container and a force of resistance to move the ink so as to be absorbed by the negative pressure producing member are initially governing.

Since flow resistance of the negative pressure producing member in the configuration according to the present invention is higher than resistance to restoration of the bag, the internal space of the ink container is first increased as the air is swollen as shown in FIGS. 13A1 and 13A2. When an increase of a volume caused by swelling of the air is larger than an upper limit of this increment, the ink flows from the ink container into the negative pressure producing member chamber by way of the vapor-liquid exchange path as shown in FIGS. 13B1 and 13B2. That is, the wall surfaces of the ink container functions as a buffer to the environmental changes, thereby moderating a movement of the ink in the negative pressure producing member and stabilizing a negative pressure characteristic of the ink supply port.

In this embodiment, the ink which is flowed into the negative pressure producing member chamber is held by the negative pressure producing member. In this case, an amount of the ink is temporally increased in the negative pressure producing member chamber and the vapor-liquid interface is enhanced as shown in FIGS. 13C1 and 13C2, thereby changing an internal ink pressure slightly on a positive side of that at an initial stage of use, but this change of the internal ink pressure produces a small influence on liquid discharge recording means such as a recording head and poses no problem in practical use. When the atmospheric pressure restores to a level before the reduction of the pressure (returns to 1 atmospheric pressure) (or when atmospheric temperature returns to an initial level), ink which has leaked into the negative pressure producing member chamber and held by the negative pressure producing member returns into the ink container and the volume of the ink container restores an initial condition.

Next, description will be made with reference to FIG. 14 of a principle and operations in a stationary condition shown in FIGS. 13D1 and 13D2 which is obtained at a changed atmospheric pressure after initial operations after a change of the atmospheric pressure.

A characteristic of this stationary condition lies in that an interface of the ink held in the negative pressure producing member changes so as to be balanced with not only the amount of the ink discharged from the ink container but also a change of the negative pressure due to a volumetric change of the ink container itself.

In this respect, speaking of relationship between an amount of the ink to be absorbed by the negative pressure producing member and the ink container chamber in this invention, it is sufficient from a view point to prevent the ink from the atmosphere communicating port or the like during the above described pressure reduction or the temperature change to determine a maximum amount of the ink to be absorbed in the negative pressure producing member chamber taking into consideration an amount of the ink to be discharged from the ink container chamber in a worst condition and an amount of the ink to be held in the negative pressure producing member chamber when the ink is supplied from the ink container chamber, and configure the negative pressure producing member chamber so as to have a capacity to accommodate the negative pressure producing member which has absorbed the ink in the maximum amount.

Figure 14:
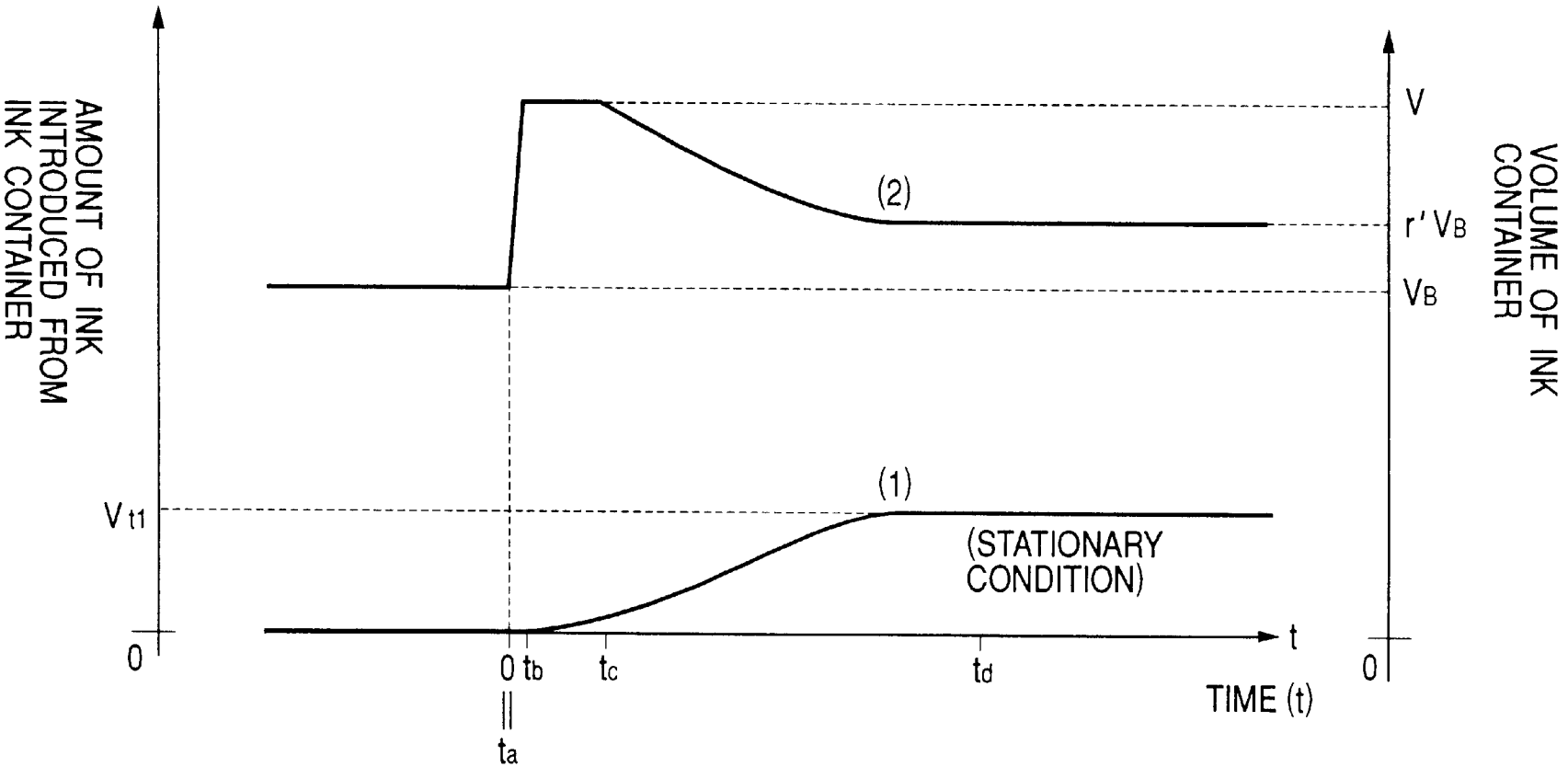
FIG. 14 is a diagram descriptive of an amount of ink flowing from the ink tank shown in FIGS. 1A and 1B at a reduced pressure or a diagram descriptive of changes with time in an amount of ink discharged from the ink container and a volume of the ink container which are caused by changing an environment of the tank from atmospheric pressure to a reduced pressure of $P(0<P<1)$.

FIG. 14 shows schematically an amount of the ink discharged with time from the ink container and a volume of the ink container in the case where an environment of the tank is changed at t=0 and a pressure of P atmospheric pressure ($0<P<1$) reduced from the atmospheric pressure. In FIG. 14, an ordinate represents time (t), an abscissa designates the amount of the ink discharged from the ink container and the volume of the ink container, a change with time of the amount of the ink discharged from the ink container is represented by a solid line (1) and a change with time of the volume of the ink container is designated by a solid line (2).

In FIG. 14, conditions of the ink tank corresponding to t=ta, t=tb, t=tc and t=td are shown in FIG. 13A1, 13A2, 13B1, 13B2, 13C1, 13C2, 13D1 and 13D2 respectively.

As shown in FIG. 14, the ink container can mainly cope with the swelling of air caused by an abrupt environmental change before the stationary condition is finally entered that the negative pressures are balanced between the negative pressure producing member chamber and the ink container chamber. Accordingly, the ink container chamber is capable of delaying a timing to discharge the ink from the ink container chamber into the negative pressure producing member chamber when an abrupt environmental change occurs.

Accordingly, the ink tank according to the present invention makes it possible to provide an ink supply system which is capable of supplying ink in a stable negative pressure condition during use of an ink container chamber while enhancing allowance to swelling of external air introduced by the vapor-liquid exchange under various environments for use. The ink supply system according to the present invention permits optionally determining a ratio between a volume of a negative pressure producing member chamber and that of an ink container chamber by adequately selecting materials of a negative pressure producing member and an ink container to be used, and is practically usable even when the ratio is higher than 1:2. When importance is placed on a buffer effect of the ink container chamber in particular, a deformation ratio of the ink container between an operation start condition and a vapor-liquid exchange condition is to be enhanced within a range where the ink container is elastically deformable.

In addition, it is desirable for allowing the ink container to exhibit the buffer effect that air exists in a small amount in the ink container while the ink container is deformed little, that is, air exists in an amount as small as possible after connection and before the vapor-liquid exchange condition.

First Embodiment

Figure 15A:
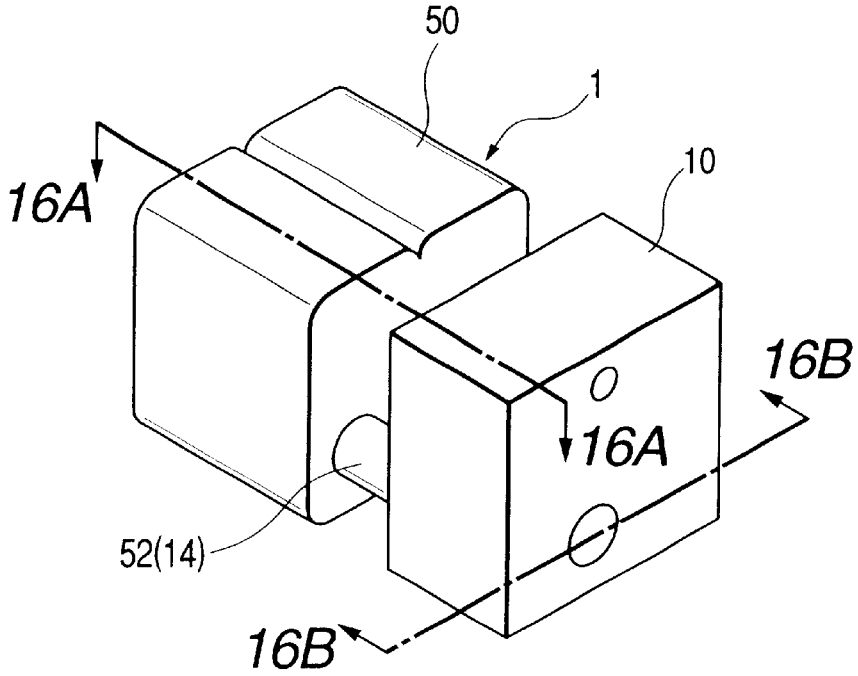
FIGS. 15A, 15B and 15C are schematic diagrams descriptive of an ink tank in a first embodiment to which the liquid supply system according to the present invention is applicable.
Figure 15B:
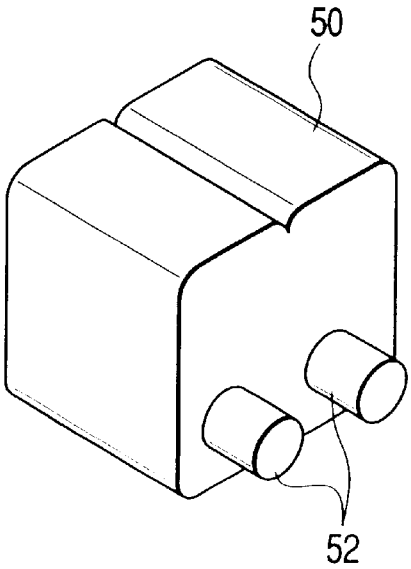
Figure 15C:
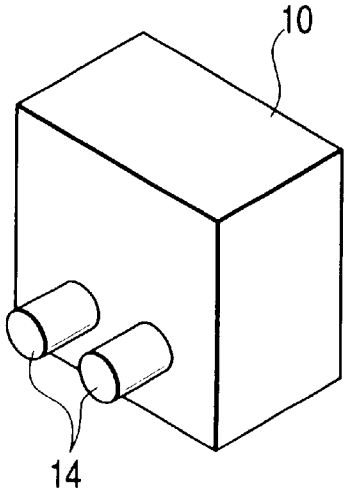

FIGS. 15A, 15B and 15C are schematic diagrams showing a first embodiment of an ink tank to which the liquid supply system according to the present invention is applicable: FIG. 15A is a perspective view of the ink tank as a whole, FIG. 15B is a perspective view of an ink container chamber and FIG. 15C is a perspective view of a negative pressure producing member chamber.

Figure 16A:
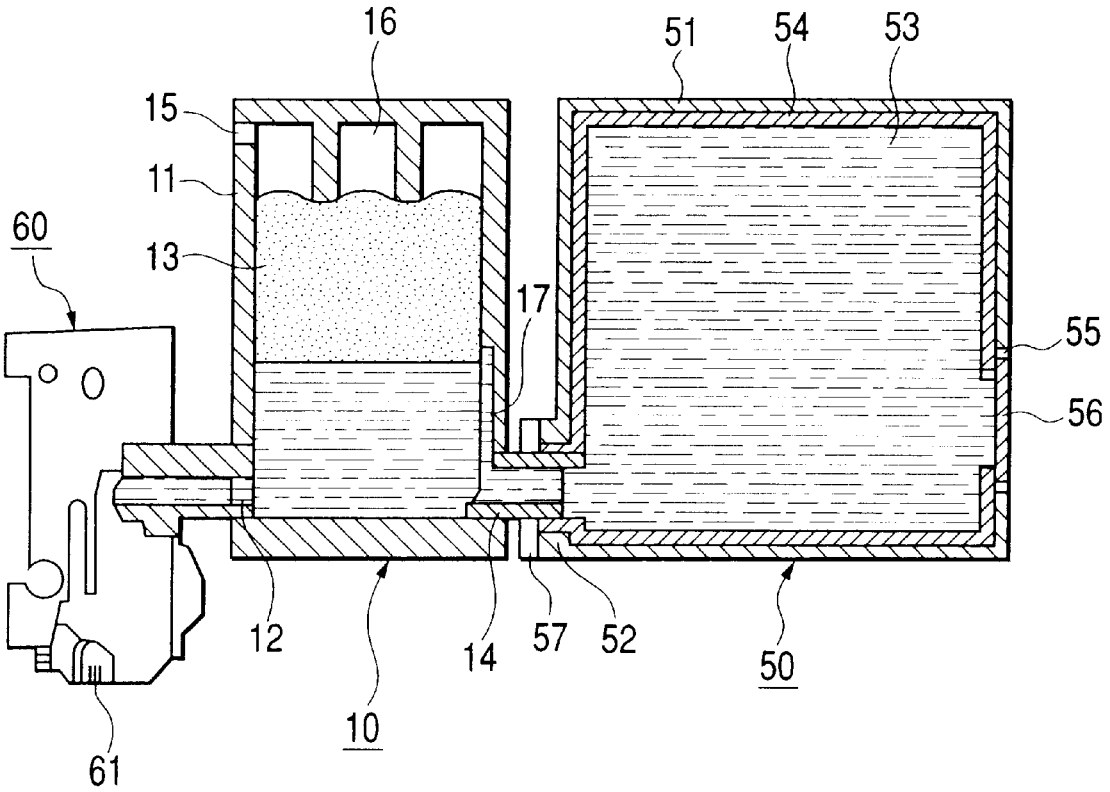
FIGS. 16A and 16B are schematic configurational diagrams of an ink tank.
Figure 16B:
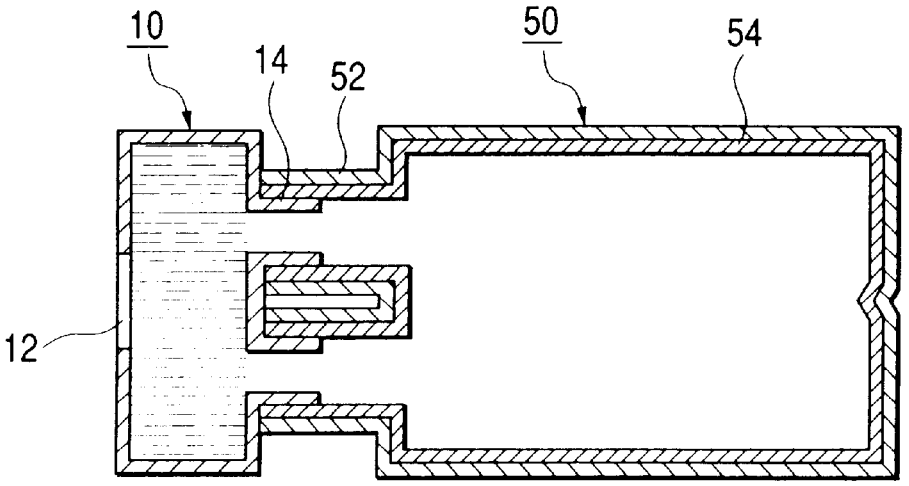

FIGS. 16A and 16B are schematic configurational diagrams of the ink tank: FIG. 16A is a sectional view taken along an 16A—16A line in FIG. 15A and FIG. 16B is a sectional view taken along a 16B—16B line in FIG. 15A.

As shown in FIGS. 15A, 15B, 15C, 16A and 16B, an ink tank 1 is configured by a negative pressure producing member chamber 10 and an ink container chamber 50, which is separably connected to the negative pressure producing member chamber 10 by way of a communicating section.

The negative pressure producing member chamber 10 comprises a cabinet 11 which has an ink supply port 12 for supplying ink (including a liquid such as a treating liquid) to an outside such as recording head 60 or the like which performs recording by discharging a liquid from a discharge port 61, a negative pressure producing member 13 which is composed of a porous material such as polyurethane foam accommodated in the cabinet, and a communicating pipe (vapor-liquid exchange path) 14 which is in contact with the negative pressure producing member and functions to introduce the liquid from the ink container chamber. The cabinet 11 is further equipped, inside a side wall surface in the vicinity of the communicating pipe, with an atmosphere inlet groove 17 for accelerating vapor-liquid exchange described later and an atmosphere communicating port 15 for communicating the internally accommodated negative pressure producing member with external air, and a buffer section 16 which is composed of a rib protruding from an inside surface of the cabinet is disposed in the vicinity of the atmosphere communicating port 15. In the first embodiment, the vapor-liquid exchange path 14 is in contact with the negative pressure producing member 13 and has an end continuous to the atmosphere inlet groove 17, thereby smoothly carrying out a liquid supply operation.

In the first embodiment, the negative pressure producing member chamber 10 is equipped with two communicating pipes (vapor-liquid exchange paths) 14 as joints to the ink container chamber 50 and the ink supply port 12 for the recording head 60.

On the other hand, the ink container chamber 50 comprises a cabinet (outside wall) 51 which composes the chamber, an ink container 53 which is configured by a wall (inside wall) 54 having an inside surface identical or similar in a shape to an inside surface of the cabinet and internally accommodates ink, and an ink discharge port 52 which is connected to the vapor-liquid path 14 of the negative pressure producing member chamber to discharge the liquid from the liquid container 53 into the negative pressure producing member chamber.

The inside wall 54 has flexibility and the ink container 53 is deformable as the internally accommodated ink is discharged. Furthermore, the inside wall 54 has a soldered section (pinch-off section) 56 at which the inside wall is supported in a condition where it is engaged with the outside wall. Furthermore, an atmosphere communicating port 55 is disposed in the outside wall so that external air can be introduced between the inside wall and the outside wall.

The ink container chamber 50 is configured by six planar surfaces in an approximate form of a rectangular parallelepiped and the cylindrical ink discharge port 52 is attached to the ink container chamber 50. A surface of the rectangular parallelepiped form which has a maximum area is traced indirectly in FIG. 16A.

In the first embodiment, the ink container chamber 50 has a volume several times as large as that of an ordinary tank and two ink outlet ports 52 are attached. It is desirable that a center portion of the ink container chamber 50 has a concavity form as shown in FIGS. 15A and 15B. This concavity form permits judging at a glance how many times a volume of the ink container chamber is as large as that of the ordinary tank. Furthermore, the concavity functions as a deformation restricting member when the ink container chamber is deformed, thereby allowing a side surface which originally has the maximum area to be deformed preferentially. Accordingly, this concavity provides a merit to enable to supply the liquid stably when the tank has a form similar to a regular hexahedron in particular.

The two communicating pipes 14 of the negative pressure producing member chamber are set at a substantially same horizontal height. Strictly speaking, the substantially same height includes a configuration where top ends of the respective pipes are in contact with a vapor-liquid interface in the negative pressure producing member chamber 10 at a vapor-liquid exchange time (in case of a positional relationship in the first embodiment) and the vapor-liquid exchange operation can be carried out in both the joints. Practically, it is allowed to regard that the communicating pipes are at the substantially same horizontal height when a difference in height is on the order of a width of the communicating pipe in a vertical direction.

Then, description will be made of characteristic operations of the ink container in the first embodiment.

(Distribution of Ink Supply Paths)

Figure 17A:
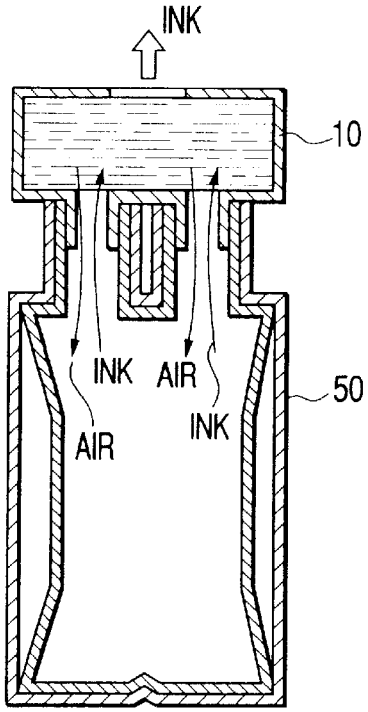
FIGS. 17A and 17B are diagrams descriptive of a distribution of ink supply passages.
Figure 17B:
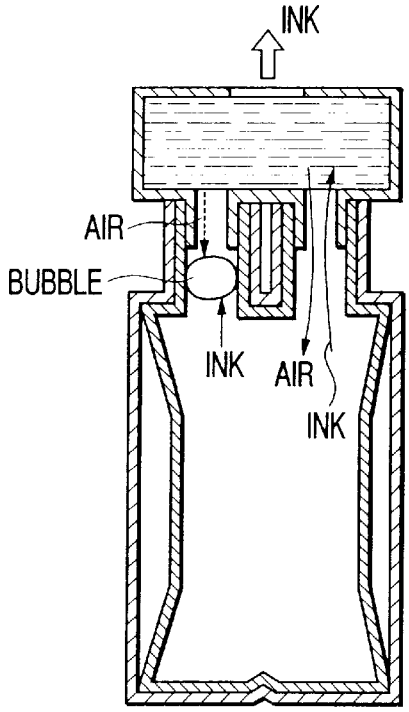

FIGS. 17A and 17B are diagrams descriptive of a distribution of the ink supply paths.

As shown in FIG. 17A, the vapor-liquid exchange is carried out in the two joints respectively as described with reference to the principle in a normal condition where the ink is supplied in a large amount per time.

Even when air bubbles are accumulated in a pipe for some cause as shown in FIG. 17B and the pipe in which the air bubbles are accumulated hinders the ink from moving from the ink container chamber 50 into the negative pressure producing member chamber 10, liquid supply can be continued since the other pipe can function normally. In case of high-speed supply in particular, a negative pressure in the ink container chamber is temporally higher than that in the negative pressure producing member chamber 10 in most cases and staying air bubbles can move into the ink container chamber when a pressure difference reaches a certain level. A condition shown in FIG. 17A is resumed subsequently.

(Modification of Ink Supply Speed)

Figure 18A:
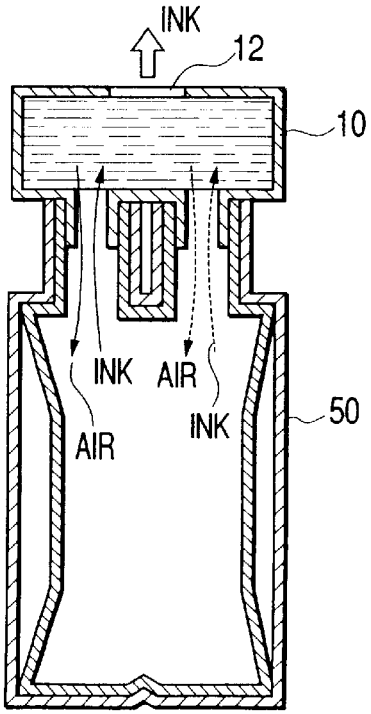
FIGS. 18A and 18B are diagrams descriptive of a change of an ink supply speed.
Figure 18B:
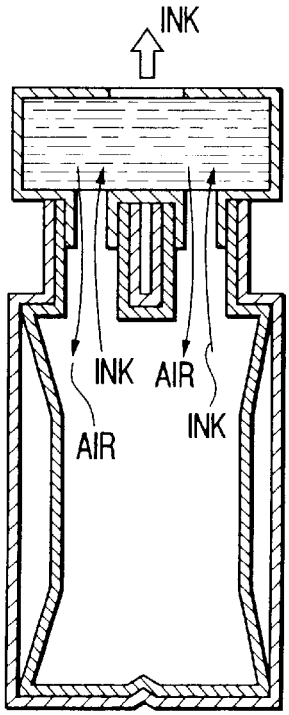

FIGS. 18A and 18B are diagrams descriptive of a modification of an ink supply speed.

When the ink is supplied in a small amount from the ink supply port 12, the vapor-liquid exchange operation is carried out positively first in a joint having ink resistance which is relatively low out of the two joints as shown in FIG. 18A. Though a gas is supplied through one joint and the liquid is supplied through the other joint in a certain case, this configuration is also included in the present invention.

When the ink is supplied in a large amount from the ink supply port 12 for monochromatic printing as shown in FIG. 18B, the vapor-liquid exchange is carried out in both the joints. That is, the first embodiment is capable of feeding the ink stably from the ink container chamber 50 into the negative pressure producing member chamber 10 even for the high-speed printing by using a plurality of ink supply paths dependently on an ink supply speed to the outside. Accordingly, the first embodiment is free from a fear of exhaustion of the ink in the negative pressure producing member chamber 10.

Second Embodiment

Figure 19A:
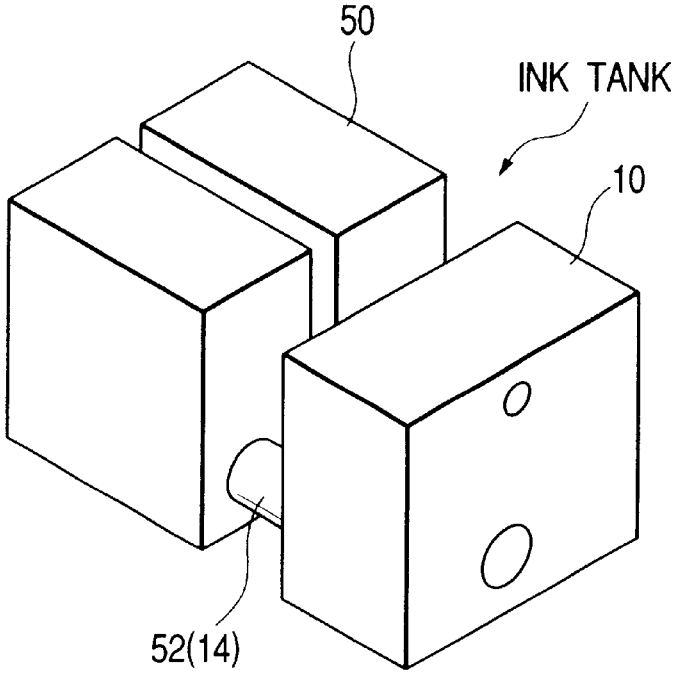
FIGS. 19A, 19B and 19C are schematic diagrams descriptive of an ink tank in a second embodiment.
Figure 19B:
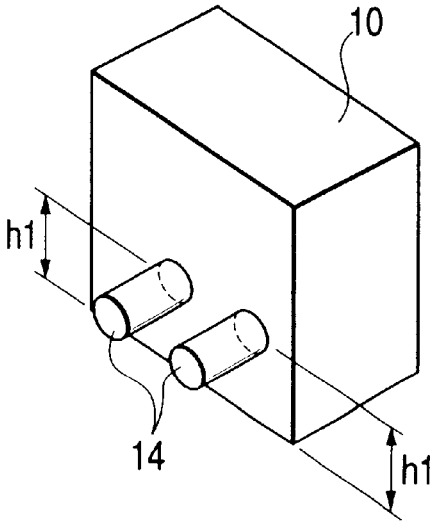
Figure 19C:
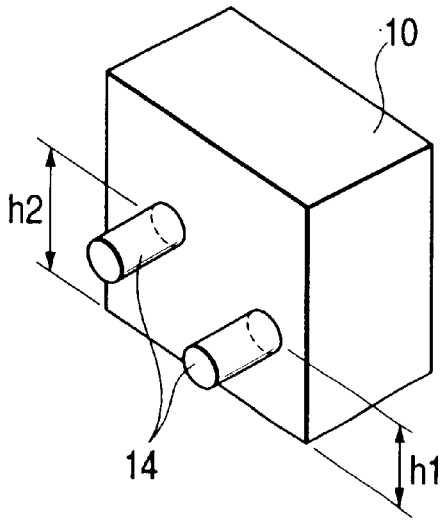

FIGS. 19A, 19B and 19C are schematic diagrams descriptive of an ink tank preferred as a second embodiment: FIG. 19A is a perspective view of the ink tank as a whole, whereas FIGS. 19B and 19C are perspective views of a negative pressure producing member chamber.

As shown in FIG. 19A, an ink tank 1 is configured by a negative pressure producing member chamber 10 and two ink container chambers 50, which are separably connected to the negative pressure producing member chamber 10 by way of communicating sections respectively.

It is desirable that both the ink container chambers 50 have forms which are the substantially the same. The two ink container chambers having the forms which are the substantially the same can be replaced with each other and prevent deformation of the ink container chambers 50 from being variable. As a modification example, however, volumes of the ink container chambers 50 may not be the same but one of the ink container chambers is larger than the other. Furthermore, the ink container chamber 50 may be composed by integrating a plurality of tanks with one another.

It is desirable that two communicating pipes 14 of the negative pressure producing member chamber 10 are set at horizontal heights (h1) which are substantially the same as shown in FIG. 19B. As a modification example, however, horizontal heights (h1, h2) of the two communicating pipes 14 of the negative pressure producing member chamber 10 may be different as shown in FIG. 19C. In this case, the ink is used preferentially in a pipe which corresponds to a higher pipe. Accordingly, only the ink container chamber 50 which corresponds to the higher pipe is to be exchanged and the lower ink container chamber 50 serves as an auxiliary tank at a time of ink supply in a large amount. That is, the communicating pipes 14 at the different horizontal heights are connected to the ink container chambers 50 which are independent of each other and may be used simultaneously at the time of ink supply in the large amount. This configuration is also included in the present invention.

A configuration of the second embodiment is similar to that of the first embodiment in other respects, which will not be described in particular.

Then, description will be made of operations of the ink container chamber in the second embodiment.

"Distribution of the ink supply paths" and "modification of ink supply speed" described above in the first embodiment remain substantially unchanged in the second embodiment and operations peculiar to the second embodiment will be described below:

(Modification of Ink Supply Speed)

FIGS. 20A, 20B, 20C and 20D are diagrams descriptive of a modification of an ink supply speed.

Figure 20A:
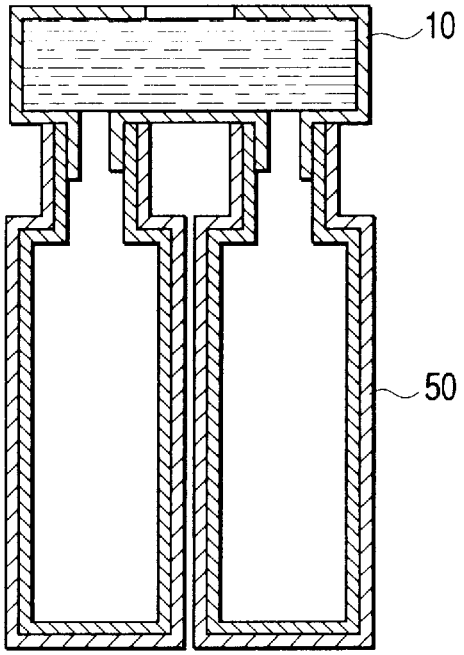
FIGS. 20A, 20B, 20C and 20D are diagrams descriptive of the ink supply speed.
Figure 20B:
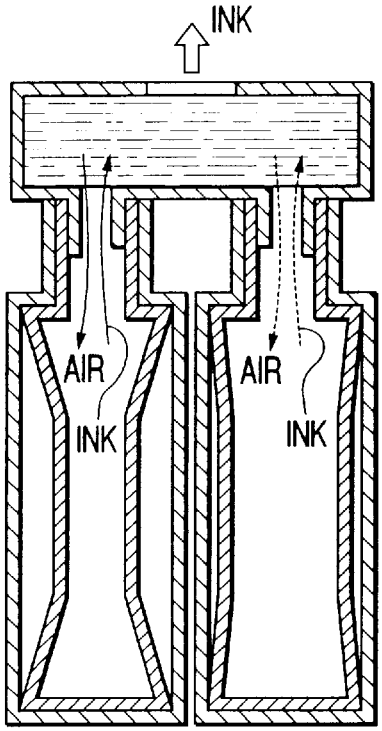
Figure 20C:
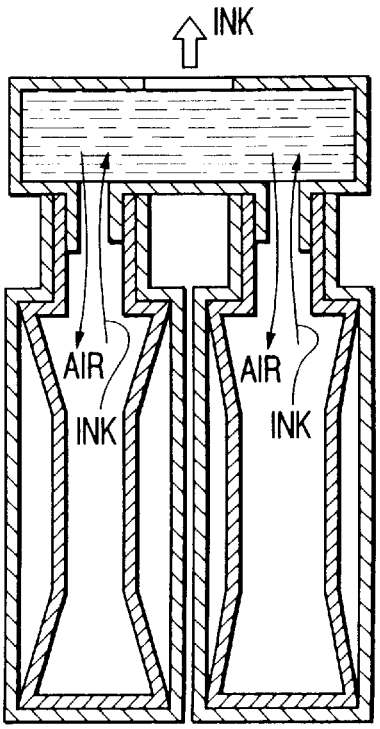
Figure 20D:
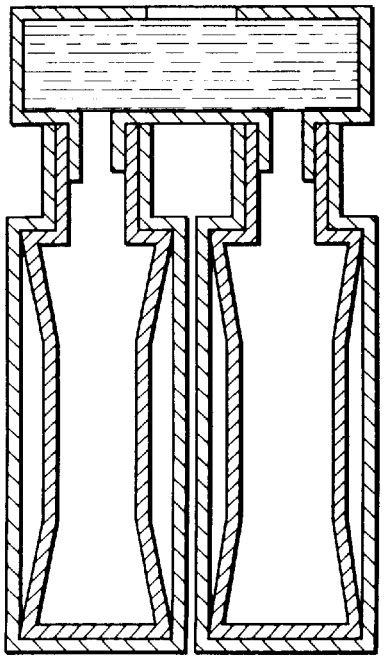

FIG. 20A shows a condition before starting the modification. FIG. 20B shows a condition where the ink is supplied in a small amount. Speaking concretely, an ink container chamber in which an air path is formed first is used preferentially. FIG. 20C shows a condition where the ink is supplied in a large amount. In the case where the ink tank is operated continuously until another air path is formed later, the ink may be supplied preferentially from a tank which has not so far been used for balancing a total of the three tanks of the negative pressure producing member chamber 10 and the two ink container chambers 50. In order to form a plurality of air paths easily, it is desirable to use an ink absorber which is composed of fibers rather than urethane foam. An ink absorber in which fibers intersect three dimensionally with other fibers and points of intersection are thermally fusion bonded is mentioned as a desirable fibrous absorber. FIG. 20D shows a stationary condition where the ink container chamber in parallel with each other. Since the two ink container chambers which are identical to each other are used in the second embodiment, ink containers are deformed identically.

Since the second embodiment does not allow the ink containers to have inflection points at which negative pressures are changed extremely even when the ink container are deformed remarkably, thereby allowing the two ink containers to be deformed remarkably. When the two ink containers are configured by accommodating air in amounts on the similar orders, the second embodiment permits expecting a result that the ink container chambers exhibit a buffer effect higher than that of the first embodiment, thereby allowing a buffer space to be reduced in the negative pressure producing member chamber.

Though the communicating pipe of the negative pressure producing member chamber is disposed on a bottom of the ink container chamber in the first and second embodiment, a configuration wherein the communicating pipe is disposed in the course of the ink container chamber is also included in the present invention.

Third Embodiment

Figure 21:
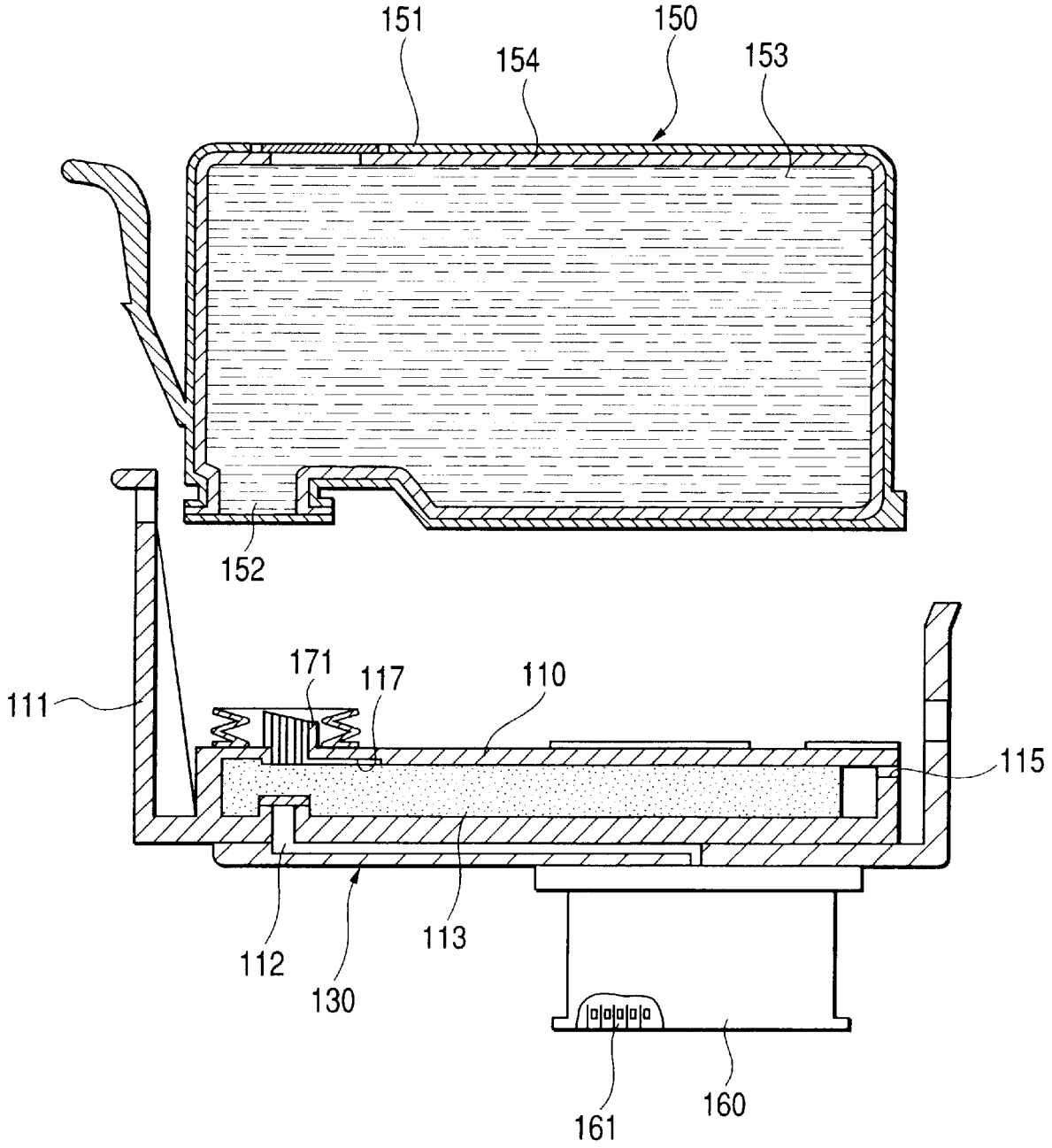
FIG. 21 is a schematic diagram descriptive of an ink cartridge in a third embodiment or a sectional view of an ink tank before it is mounted on a holder having a head.
Figure 22A:
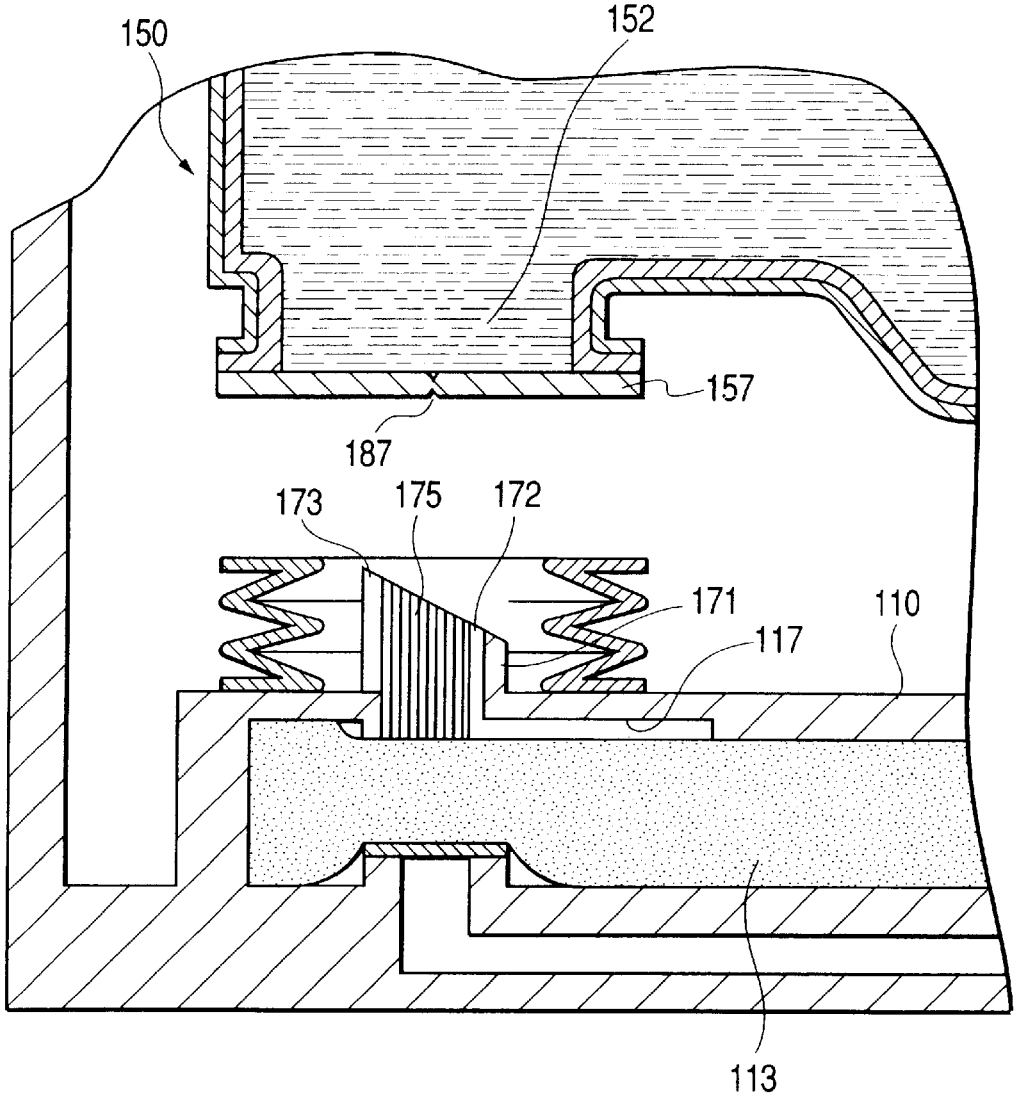
FIGS. 22A and 22B are enlarged diagrams of a connector of an ink path between the ink tank and the holder having the head shown in FIG. 21.
Figure 22B:
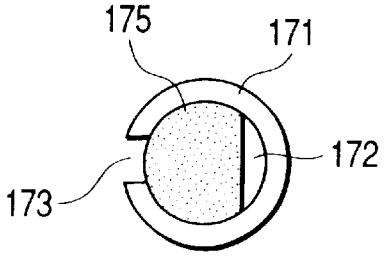

FIG. 21 is a schematic diagram descriptive of an ink-jet cartridge in a third embodiment, or a sectional view of the ink cartridge before an ink tank is mounted on a holder having a head. Furthermore, FIGS. 22A and 22B are enlarged views of a connector for an ink path between the ink tank and the holder having the head.

The ink cartridge in the third embodiment comprises an ink tank 150 for internally accommodating ink, a tank holder 111 for holding the ink tank 150, a negative pressure producing member chamber 110 for temporally holding the ink supplied from the ink tank 150 and a holder having a head 130 integrated with a recording head 160 for performing recording by discharging the ink supplied from the negative pressure producing member chamber 110 which are integrated with one another.

The ink tank 150 is detachably attached to the holder having the head 130, and is configured, like the ink tank in the first embodiment, by an outside wall 151 and an inside wall 154, and comprises an ink container 153 for internally accommodating the ink and an ink supply section 152 which discharges a liquid from the ink container 153 into the negative pressure producing member chamber 110.

In the third embodiment, however, the ink tank 150 is to be mounted on the negative pressure producing member chamber 110 and the ink supply section 152 is open in a lower end surface of the ink tank 150.

On the other hand, the holder having the head 130 has the tank holder 111 for holding the ink tank 150, the negative pressure producing member chamber 110 disposed on a bottom of the tank holder 111 and the recording head 160 for performing recording on a recording medium by discharging the ink (including a liquid such as a treating liquid) from a discharge port 161, and has a configuration where the above mentioned members are integrated with one another.

A communicating pipe 171 which is connected to the ink supply section 152 of the ink tank 150 and communicated with the ink container 153 is disposed on a top wall of the negative pressure producing member chamber 110 and an ink supply port 112 for supplying the ink to the recording head 160 is open in a bottom wall of the negative pressure producing member chamber 110. The ink supply port 112 is disposed below the communicating pipe 171.

As in the first embodiment, the negative pressure producing member chamber 110 has an atmosphere inlet groove 117 for accelerating the vapor-liquid exchange and an atmosphere communicating port 115 for communicating a negative pressure producing member 113 with external air. The atmosphere inlet groove 117 is formed inside a surface of the top wall in the vicinity of the communicating pipe 171 in a horizontal direction toward another end of the negative pressure producing member chamber 110 and communicated with an inside of the communicating pipe 171. The atmosphere communicating port 115 is formed in a top of a wall at the other end of the negative pressure producing member chamber 110.

Structures in the vicinities of the ink supply section 152 of the ink tank 150 and the communicating pipe 171 of the holder having the head 130 will be described in detail with reference to FIGS. 22A and 22B.

An ink inducer 175 is inserted in the communicating pipe 171. An atmosphere inlet path 172 which is communicated with the atmosphere inlet groove 117 is formed in an inside wall of the communicating pipe 171 from a top end to a lower end of the communicating pipe 171. Furthermore, a slit 173 is formed in the communicating pipe 171 by cutting off a portion of a pipe wall of the communicating pipe 171 in an axial direction. A top end surface of the communicating pipe 171 is slanted so that a location where the atmosphere inlet path 172 is open is the lowest.

On the other hand, an unsealing groove 187 is formed in a sealing member 157 which is soldered to the ink supply section 152 of the ink tank 150 so that the sealing member 157 is broken at the unsealing groove 187 and the communicating pipe 171 is inserted into the ink supply section 152 when the ink supply section 152 is pressed into the communicating pipe 171.

The third embodiment has a configuration which is similar to that of the first embodiment in other respects which will not be described in particular.

Figure 23:
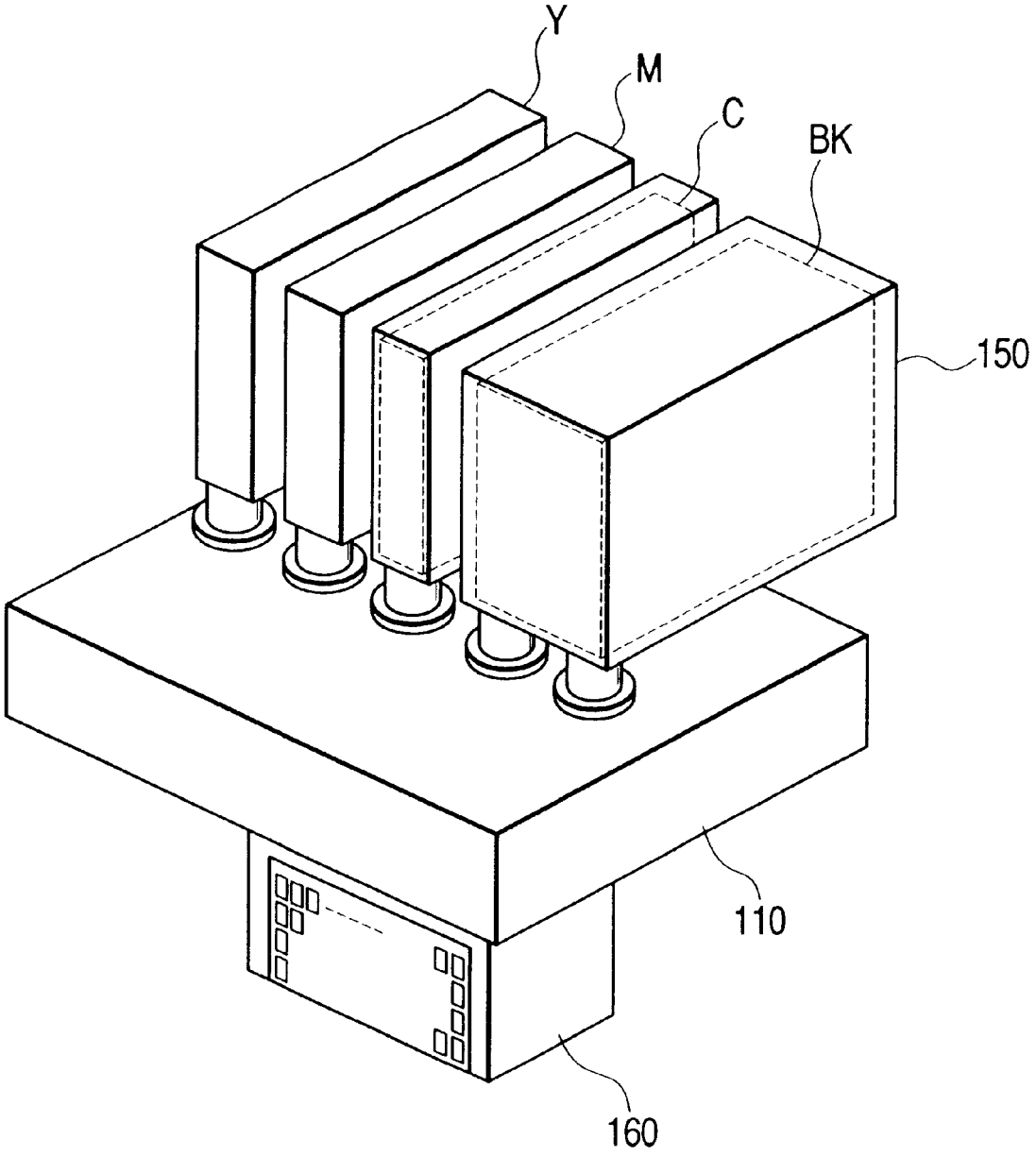
FIG. 23 is a perspective view of the ink cartridge shown in FIG. 21.

Since the ink tank 150 is mounted over the negative pressure producing member chamber 110 in the third embodiment as described above, the third embodiment provides an effect to supply the ink from the ink tank 150 to the ink supply port 112 in a direction along the gravity in addition to effects which are similar to those of the first embodiment, thereby being capable of always maintaining stable supply condition. Moreover, the third embodiment is capable of performing the vapor-liquid exchange smoothly owing to a fact that the atmosphere inlet groove 117 connected to the communicating pipe 171 is disposed in the horizontal direction. Since the top end surface of the communicating pipe 171 is slanted as described above, the ink inducer 175 is communicated earlier with the ink container 153 when the coupling pipe 171 is inserted into the ink supply section 152 of the ink tank 150 and the ink flows from the ink container 153 preferentially into the ink inducer, the third embodiment is capable of efficiently supplying the ink from the ink container 153 into the negative pressure producing member 113. FIG. 23 is a perspective view of the ink cartridge shown in FIG. 21.

In the third embodiment in which the liquid supply system according to the present invention is applied to a color ink cartridge, four ink tanks 150 are detachably held over the negative pressure producing member chamber 110. The individual ink tanks 150 are configured like the ink tanks used in the first and second embodiments, and contain ink of different colors, for example, four colors of yellow (Y), magenta (M), cyanic (C) and black (Bk). An interior of the negative pressure producing member chamber 110 is divided into four chambers corresponding to the ink tanks 150 and a negative pressure producing member (not shown) is accommodated in each chamber. A recording head is integrated with a bottom of the negative pressure producing member chamber 110.

The third embodiment relates to the ink cartridge in which the ink tanks 150 are mounted over the negative pressure producing member chamber 110 and the liquid supply system of the first embodiment is applied to an ink tank for ink which is used in a large amount, for example, black ink.

The operations for "distribution of ink supply paths" and "modification of ink supply speed" described in the first embodiment are similar to those in the third embodiment, which will not be described in particular.

In case of the third embodiment, the ink inducer which is a fiber bundle member having a capillary force stronger than that of the negative pressure producing member is inserted as the liquid inlet path in the communicating pipe used as the communicated section and the atmosphere inlet path is formed as a preferential gas inlet path in the inside wall of the communicating pipe as described above.

Since the liquid outlet path and the gas inlet path are disposed in the communicated section as described above, the third embodiment is capable of discharging the liquid securely and stably into the negative pressure producing member containing vessel. Furthermore, since a gas passage is maintained at a time of the vapor-liquid exchange as described above, the third embodiment is easily capable of carrying out the vapor-liquid exchange regardless of an amount of the liquid held in the negative pressure producing vessel. Furthermore, the third embodiment is capable of introducing the liquid even when air is accumulated in the preferential gas inlet path of the communicated section.

For carrying out the vapor-liquid exchange in a plurality of paths at a time of the high-speed supply in the third embodiment, it is sufficient that ends of the pipes which are apart from the supply ports are in contact with the interface in the negative pressure producing member chamber at a time of the vapor-liquid exchange.

Furthermore, the third embodiment may have a configuration wherein an ink container chamber corresponds to each joint as in the second embodiment. In this case, distances from the supply ports to the joints may be different from each other so far as the vapor-liquid exchange can be carried out in each path at the time of high-speed supply.

Fourth Embodiment

A fourth embodiment will be described referring to the first embodiment.

Figure 24A:
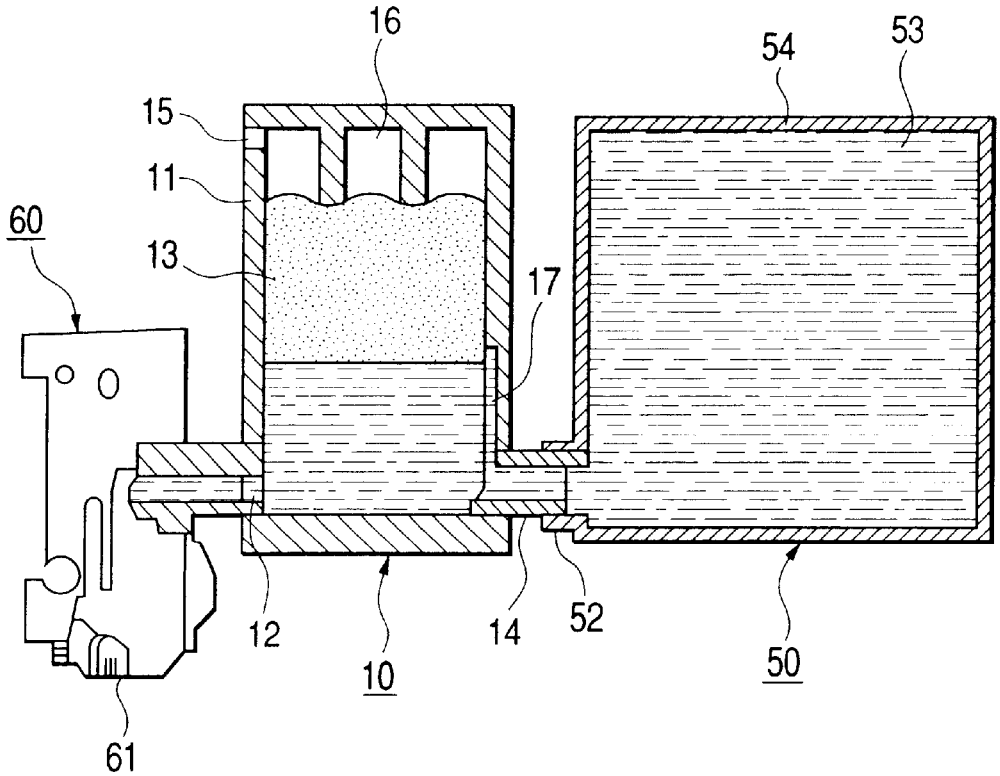
FIGS. 24A and 24B are schematic configurational diagrams of an ink tank in a fourth embodiment.
Figure 24B:
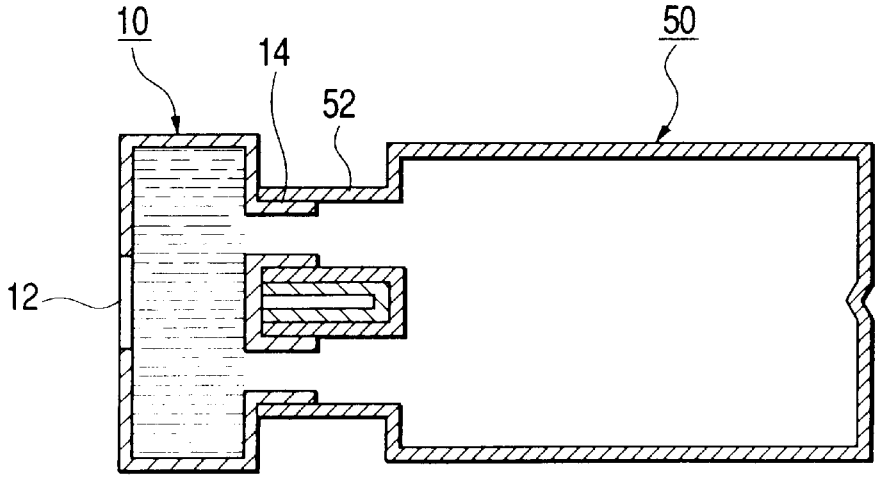

FIGS. 24A and 24B are schematic diagrams of an ink tank preferred as the fourth embodiment: FIG. 24A being a sectional view taken along the 16A—16A line in FIG. 15A and FIG. 24B being a sectional view taken along the 16B—16B line in FIG. 15A.

As shown in FIGS. 24A and 24B, the ink tank is configured as a tank which does not use the cabinet (outside wall)

51 of the first embodiment shown in FIG. 16A but is composed only of an inside wall 54 configured as an ink container which has rigidity and is not deformed as the ink is discharged.

The fourth embodiment has a configuration similar to that of the first embodiment in other respects, which will not be described in particular.

The fourth embodiment which has the configuration described above does not allow the liquid to be discharged until a gas is introduced, thereby preventing only the liquid to be discharged precedingly as in case of the first embodiment. Though the first embodiment is desirable from a viewpoint of a high-speed supply property, the fourth embodiment exhibits an effect similar to that of the first embodiment from a viewpoint of distribution of ink supply, that is, increase in the vapor-liquid exchange sections.

Though description has been made above mainly on differences from the first embodiment, the fourth embodiment is applicable needless to say to the second and third embodiments.

Other Embodiments

While description has been made above of the embodiments of the present invention, explanation will be made of examples in which the present invention is preferably applicable.

<Configuration of Ink Container Chamber>

First of all, a supplementary description will be made of the configuration of the ink container chamber in each of the embodiments described above.

When the ink container chamber is attachable and detachable to and from the negative pressure producing member, the sealing means is disposed in the section of the ink container chamber communicated with the negative pressure producing member chamber as a member which prevents the liquid or air from leaking through the communicated section while the ink container is attached and prevents the ink from being discharged from the ink container before the ink container is attached. Though film like members are used as the sealing means in the first through fourth embodiments described above, a ball like stopper may be used as the sealing means. Furthermore, a hollow needle may be used as the vapor-liquid exchange path and a rubber stopper may be used as the sealing means.

Furthermore, the ink container chamber is formed by a direct blow manufacturing method in each of the embodiments described above. Speaking concretely, the cabinet (outside wall) and the ink container (inside wall) which are separable from each other are formed by swelling cylindrical parisons uniformly relative to dies of approximately polygonal prisms by blowing air. In place of the ink container chamber, flexible bags in which metallic springs or the like are disposed may be used to produce a negative pressure as the ink is discharged.

However, blow molding provides not only a merit to facilitate to manufacture a container which has an external form identical or similar to an internal form of a cabinet but also a merit to allow a negative pressure to be easily produced by changing a material and thickness of an inside wall which composes the ink container. Furthermore, it is possible to provide an ink container chamber which has a high recycle property by utilizing a thermoplastic resin as a material of the inside wall and the outside wall.

Figure 25B:
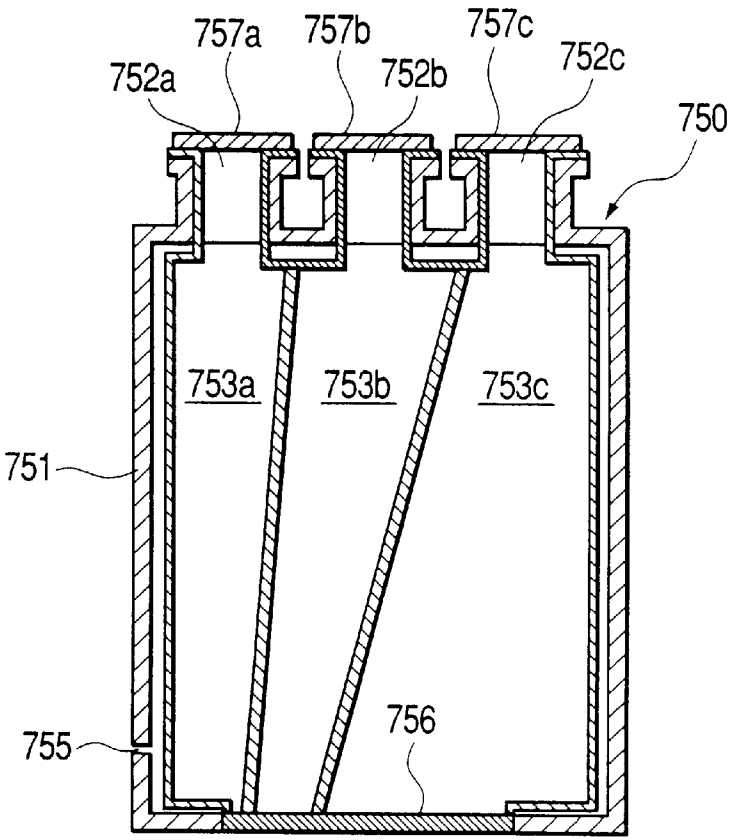
FIGS. 25A and 25B are schematic diagrams showing a further modification example of the ink tank to which the liquid supply system according to the present invention is applicable.
Figure 25A:
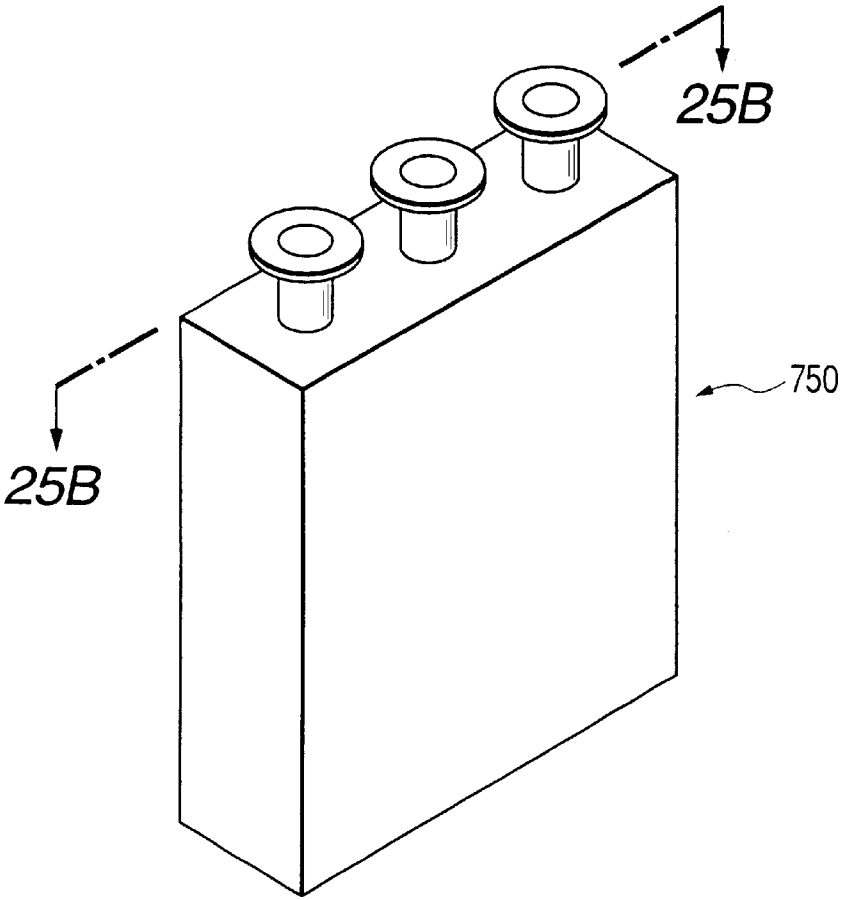

Furthermore, an ink tank such as that shown in FIGS, 25A and 25B can easily be manufactured by using the blow molding. FIGS, 25A and 25B are diagrams descriptive of an example of an ink container vessel having a plurality of ink containers integrated with one another: FIG. 25A being a perspective view and FIG. 25B being a sectional view taken along an 25B—25B line in FIG. 25A. An ink container vessel 750 comprises a plurality of ink containers 753*a*, 753*b* and 753*c* for holding ink, and ink outlet ports 752*a*, 752*b* and 752*c* which are sealed with sealing means 757*a*, 757*b* and 757*c* can be connected to the ink containers. The ink containers used in the ink container vessel 750 shown in FIGS. 25A and 25B have volumes which are different from one another so that liquids can be supplied in amounts variable dependently on frequencies of use.

Supplementary description will be made of a structure of the "outside wall" and a structure of the "inside wall" obtained as a result of an influence due to the "outside wall" in each of the embodiments described above.

Since the ink container chamber is manufactured by blow molding in each of the embodiments described above, the inside wall is formed so that the vicinity of an angle is thinner than an area in the vicinity of a center of a surface composing a vessel. Similarly, the outside wall is also formed so that the vicinity of an angle is thinner than an area in the vicinity of a center of a surface composing a vessel. Furthermore, the inside wall is formed by being laminated with the outside wall which has a thickness distribution gradually reduced from a central portion toward an angle of each surface.

As a result, the above described inside wall has an outside surface which is matched with an inside surface of the outside wall. The outside surface of the inside wall is formed along the distribution in thickness of the outside wall, the outside surface is convex toward an ink container formed by the inside wall. An inside surface of the inside wall has the distribution of the thickness of the inside wall described above, thereby being more convex toward the ink container. Since these structure performs the above described function at the surfaces having the maximum areas, it is sufficient for the present invention that such a convex shape is formed on the surface having the maximum area, and have a height of 2 mm or smaller on an inside surface of the inside wall and 1 mm or smaller on an outside surface of the inside wall. Though this convex shape may be within a range of a measuring error on a surface which has a small area, the convex shape is a factor to provide a priority order of deformation of the surfaces of the ink tank of the approximately polygonal prism and one of conditions preferable for the present invention.

In addition, supplementary description will be made of a structure of the outside wall. As one of functions of the outside wall, restriction of the deformation of the angle of the inside wall is mentioned above, but the outside wall may have any structure (angle part covering member) so far as the structure exhibits functions to maintain the form of the inside wall against the deformation and cover circumferences of the angle parts. Accordingly, the outside wall can be made of a material such as plastic, metal or cardboard so as to have a structure covering the outside wall or the inside wall. The outside wall may have an entire surface structure, partial surface structures covering the angle parts and coupled with bars of metal or the like or a mesh structure.

When the ink is exhausted for some cause from a region in the vicinity of the vapor-liquid exchange path to a region the vicinity of the ink supply port of the negative pressure producing member at the exchange time of the ink container in case of the exchangeable type ink container, a normal condition can easily be restored by manually pressing the elastically deformable outside wall together with the inside wall as shown in FIG. 26 so as to forcibly move the ink from the ink container chamber into the negative pressure producing member chamber. Such a pressing restoration operation may be performed not manually but automatically and pressing restoration means may be disposed on a recorder described later. When the inside wall is partially exposed, an exposed portion only may be depressed.

Though the ink container has an approximate form of a polygonal prism in the embodiments of the present invention, this form is not limitative and an ink container can accomplish the first object of the present invention so far as the ink container can be deformed by ink discharge at least and produce a negative pressure due to deformation.

However, it is more preferable that a deformation amount of the ink container corresponds to a negative pressure in the ink discharge port in a relation of approximately 1:1 even after the ink contained has been repeatedly formed and restored. Such a desirable condition can easily be obtained by deforming the ink container within an elastic deformation of the ink container.

In case of this embodiment, the ink container is kept in a condition where it is slightly deformed even when pressure is zeroed in the ink discharge port after the vapor-liquid exchange operation. Even when the ink container is not elastically deformed in some regions as described above but is elastically deformed in regions other than the regions, it is regarded that the ink container is substantially deformed elastically.

When the ink tank exhibits a condition of an abrupt change of a variation ratio of the negative pressure which is produced by the deformation caused by ink discharge (for example, when deformed portions are brought into contact with each other), it is desirable to configure the ink tank so as to terminate the first ink supply condition and start the second ink supply condition before the condition of the abrupt change.

Furthermore, the liquid vessel of the liquid supply system according to the present invention may be made of any material so far as the material permits separating the inside wall from the outside wall, and the inside wall and the outside wall may be composed of multiple layers using a plurality of materials for each wall. Furthermore, the ink container permits using an inside wall having an elasticity higher than that of an inside wall disposed in an ink container which is to be used independently as a negative pressure producing type liquid vessel. As compared with the ink container which is to be used independently as the negative pressure producing vessel, the ink container is preferably usable as an exchange ink container for an ink-jet recorder even when the ink container uses an inside wall which is thick or highly rigid, thereby providing a merit to widen a material selection range. A thicker inside wall can lower gas permeability. Reduction of gas permeability is desirable since it makes it possible to prevent swelling of the ink container chamber and ink leakage, for example, during distribution and custody for sale of the ink container chamber as an independent product.

When an influence on in or the like contained in the ink container is taken into consideration, polyethylene resin, polypropylene resin or the like can preferably be used as materials for the inside wall. Though the inside wall and the outside wall have single layer structure in the embodiments and application example described above, the inside wall and the outside wall may have multi-layer structures made of different materials. As compared with the ink container which is to be used independently as the negative pressure producing vessel, the ink. container according to the present invention is usable as the exchange ink container for the ink-jet recorder even when the inside wall is made of a thick material or a highly rigid material, thereby providing a merit to widen a selection range for a combination of materials for the inside wall.

<Structure of Negative Pressure Producing Member Chamber>

Now, supplementary description will be made of a structure of the negative pressure producing member chamber used in the embodiments described above.

In addition to porous materials such as polyurethane foam, felts of fibers, thermally formed lumps of fibers or the like are usable as the negative pressure producing member to be accommodated in the negative pressure member chamber (negative pressure producing member containing vessel).

Though the tubular vapor-liquid exchange path (communicated section) are described in the embodiments, the vapor-liquid exchange path may have any form so far as it does not hinder the vapor-liquid exchange in the vapor-liquid exchange condition.

Though the atmosphere inlet groove is formed in the inside surface of the cabinet in the embodiments described above, it is not always necessary to form the atmosphere inlet groove. When the atmosphere inlet groove is formed as a structure to accelerate the vapor-liquid exchange, however, it facilitates to form the above described vapor-liquid interface, thereby providing a merit to supply the ink more stably. That is, the atmosphere inlet groove not only stabilizes an operation to supply a liquid to an outside such as a recording head and makes it easier to take into consideration the conditions the first supply state and the second supply state described above in designing the negative pressure producing member and the ink container by forming the vapor-liquid interface.

Though the space free from the negative pressure producing member (buffer section) is reserved in the vicinity of the top surface in the embodiments described above, a negative pressure which does not hold a liquid in an ordinary condition may be charged in place of the buffer section. When the negative pressure producing member which does not hold the liquid is disposed in the buffer space, it is possible to hold the ink which is moved into the negative pressure producing member chamber by the environmental change described above.

<Ink Tank>

Though the ink container chamber is in a condition attachable and detachable to and from the negative pressure producing member chamber in the embodiments described above, the two chambers may be integrated with each other. When the two chambers are to be formed by separate forming methods (the negative pressure producing member chamber and the ink container chamber are to be formed, for example, by injection molding and blow forming respectively) and then soldered or bonded to always maintain an integrated structure, it is desirable to seal the communicated section using a sealing member such as an O ring to prevent the ink from leaking out of the communicated section provided as the coupler between the two chambers as in the embodiments described above.

In the separable structure, however, the joint tends to have a complicated structure and a large length from viewpoints of a secure sealing property of the coupler and prevention of ink leakage from the coupler at mounting and detaching stages. Accordingly, a remarkable merit to stably supply the ink is obtained by the effect described above when the present invention is applied to the separable structure in which air bubbles are potentially liable to stay in the vapor-liquid exchange path.

<Liquid Supply Operation and Ink Supply System>

Now, description will be made of the liquid supply operation and the liquid supply system.

The ink supply operation in the ink tank (ink supply system) in the embodiments described above passes through the initial condition where the ink container chamber is not connected to the negative pressure producing member chamber, the operation start condition where the chambers are connected, the first ink supply condition and the second ink supply condition. This is an example of a liquid supply operation in the ink supply system according to the present invention and the conditions may be modified, for example, into conditions in modification examples described below dependently on structures of the ink container chamber and the negative pressure producing member chamber respectively as well as a liquid discharge condition.

In an ink supply system which is free from the vapor-liquid condition, that is, the second ink supply condition preferred as a first modification example of the embodiment described above, for example, a liquid supply operation has a step of using ink in an ink container without introducing any air and only air introduced into the ink container may be taken into consideration for restricting an internal space of a liquid vessel. That is, this modification example provides an outstanding merit that it is capable of coping with an environmental change even when the restriction to the internal space of the ink container chamber is moderated. Taking an efficiency in use of the ink container into consideration, however, the vapor-liquid exchange condition which is reserved after the first ink supply condition as in the embodiments described above allows the ink in the ink container to be consumed easier.

A second modification example is the case where a liquid level is higher than a vapor-liquid interface in a negative pressure producing member chamber in the condition shown in FIGS. 2A1 and 2A2. In this case, a unidirectional ink movement into the negative pressure producing member chamber due to the capillary force is not produced out of ink movements to obtain the operation start condition described with reference to FIGS. 2B1 and 2B2.

A third modification example is the case where an ink consumption speed of a recording head is extremely high, for example, in the condition shown in FIGS. 3B1 and 3B2. In this case, the negative pressures in both the chambers are not always balanced with each other but the ink in the negative pressure producing member chamber may be consumed preferentially until a difference between both the negative pressure becomes a predetermined value or higher and the ink may be moved from the ink container chamber into the negative pressure producing member chamber when the difference between the negative pressure becomes a definite value or higher.

Such modification examples are included together with the ink supply operation and its details in the present invention.

<Liquid-jet Recorder>

Figure 27:
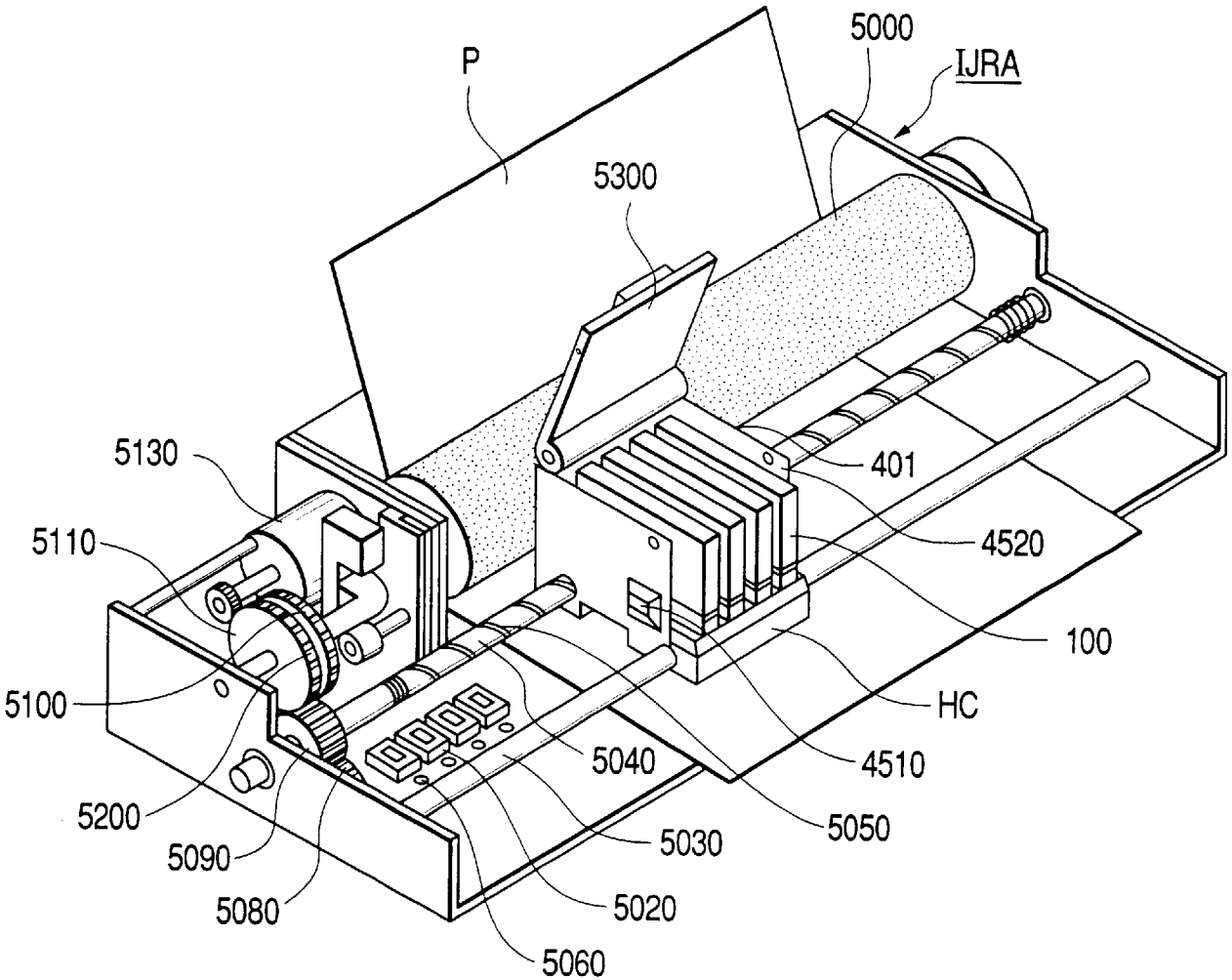
FIG. 27 is a schematic diagram showing an example of ink-jet recorder to which the liquid supply system according to the present invention is applicable.

Finally, description will be made of an ink-jet recorder which performs recording with the ink tank preferred as an embodiment of the present invention as shown in FIGS. 1A and 1B. FIG. 27 shows a schematic diagram of an ink-jet recorder which uses the ink tank preferred as the embodiment of the present invention. In FIG. 27, a head unit (not shown) and an ink tank 100 fixed and supported to a main unit of an ink-jet recorder by positioning means (not shown) of a carriage 4520 and a connecting plate 5300 rotating around a predetermined axis, and detachably mounted on the carriage respectively.

Normal and reverse rotations of a driving motor 5130 are transmitted to a lead screw 5040 by way of drive transmission gears 5110 and 5090 to rotate the lead screw 5040, and the carriage 4520 has a pin (not shown) which is engaged with a spiral groove 5050 of the lead screw 5040. Accordingly, the carriage 4520 is reciprocally moved in a longitudinal direction of the recorder.

A reference numeral 5020 denotes a cap which covers front surface of each recording head in the recorder head unit and is used to suck and return the recording head by sucking means (not shown) by way of an aperture formed in the cap. The cap 5020 is moved by a driving force transmitted by way of a gear 5080 and can cover a discharge port surface of each recording head. A cleaning blade (not shown) is disposed in the vicinity of the cap 5020 and supported movably in a vertical direction in FIG. 27. The blade is not limitative and a known cleaning blade is needless to say applicable to the liquid-jet recorder.

Capping, cleaning and suction-return can be carried out for desired treatments by functions of the lead screw 5050 when the carriage 4520 returns to its home position at locations corresponding to the treatments and applicable to the ink tank in this embodiment when members mentioned above are configured to operate as desired at known timings.

Description will be made of merits which are obtained by applying the ink tank according to the present invention to the carriage which is reciprocally moved as described above.

Since the ink tank according to the present invention uses the ink tank which is configured as a deformable member, the ink tank is capable of moderating surging of ink caused by carriage scanning with deformation of the ink tank. In order to prevent a negative pressure from being changed due to the carriage scanning, it is desirable that a portion of an angle of the ink container is not detached from a corresponding inside surface of a cabinet or located in the vicinity of the inside surface if detached. When the ink container has a pair of surfaces which are opposed to each other and have a maximum area as in this embodiment, an effect to moderate the surging of ink can be enhanced by mounting the ink container so that the surfaces which are opposed to each other and have the maximum area set nearly perpendicular to a carriage scanning direction.

Furthermore, pressure restoring means 4510 which presses an inside wall by way of an outside wall of the ink container may be mounted on the recorder as described in an item <structure of ink container>. When a liquid presence/absence detecting means 5060 which has light emitting means and light receiving means for transmitting light through an ink container chamber and detecting presence/absence of ink, non-discharge detecting means (not shown) which detects no-discharge from the recording head and control means (not shown) are disposed in this case, ink exhaustion in from a region in the vicinity of the vapor-liquid exchange path to a region in the vicinity of the ink supply port of the negative pressure producing member can be corrected by adopting, for example, a sequence described below.

When the ink container chamber is exchanged with a new ink container chamber and no-discharge from a nozzle of a head corresponding to the new ink container chamber is detected after a normal suction-restoration treatment using the cap 5020, the ink tank can be returned to a normal state with a pressure restoring operation by the pressure restoring means 4510. When an "ink presence" condition is detected by the liquid presence/absence detecting means and a "no-discharge" condition from the nozzle of the corresponding head is detected by the no-discharge detecting means and when the no-discharge cannot be corrected by the normal suction-restoration treatment, the ink container can be returned to the normal condition with the pressure restoring operation by the pressure restoring means 4510. In any case, it is preferable to attach the cap to a recording head corresponding to an ink tank which is to be pressed and restored to prevent ink from accidentally leaking from the recording head.

In addition, the liquid presence/absence detecting means may not only be an optical type described above but also another type such as a dot count type or a combined type.

What is claimed is:

1. A liquid supply system, comprising:

a liquid supply vessel having a liquid container for accommodating a liquid in a sealed space; and a negative pressure producing member containing vessel which internally accommodates a negative pressure producing member constructed to hold said liquid internally, said negative pressure producing member containing vessel including an atmosphere communicating port for communicating said negative pressure producing member with atmosphere, and plural communicating sections each communicated with said liquid supply vessel and each constructed to cause vapor-liquid exchange to discharge the liquid by introducing a gas into said liquid container.

2. The liquid supply system according to claim 1, wherein said plurality of communicating sections are all communicated with the liquid container of a single liquid supply vessel.

3. The liquid supply system according to claim 1, wherein said plurality of communicating sections are communicated with liquid containers of separate liquid supply vessels.

4. The liquid supply system according to claim 1, wherein said liquid supply vessel is separable from the negative pressure producing member containing vessel.

5. The liquid supply system according to claim 1, wherein the liquid container of said liquid supply vessel is deformed as the liquid is discharged and is, constructed to produce a negative pressure.

6. The liquid supply system according to claim 1, wherein at least some of said plural communicating sections include preferential gas inlet paths and liquid inlet paths.

7. The liquid supply system according to claim 1, wherein said negative pressure producing member containing vessel includes a liquid supply port for supplying liquid out therefrom, and wherein an amount of liquid supplied from said plurality of communicating sections is controlled dependently on an amount of liquid discharged from said liquid supply port.

8. A liquid supply system, detachably mountable to a mount, said liquid supply system comprising:

a liquid supply vessel which has a liquid container for accommodating a liquid in a sealed space; and a negative pressure producing member containing vessel which accommodates a negative pressure producing member constructed to hold said liquid internally, said negative pressure producing member containing vessel including an atmosphere communicating port for communicating said negative pressure producing member with atmosphere, and plural communicating sections, each communicated with said liquid supply vessel and each positioned at heights which are substantially the same as measured from a bottom of a side end portion of said negative pressure producing member containing vessel, wherein all of said plurality of communicating sections are communicated with the liquid container of the same liquid supply vessel, said liquid supply vessel is separably connected to the negative pressure producing member containing vessel, and said plurality of communicating sections are set at heights which are substantially the same as measured from a bottom of a side end portion of said liquid supply vessel when said liquid supply vessel is connected to said negative pressure producing member containing vessel.

9. The liquid supply system according to claim 8, wherein the liquid container of said liquid supply vessel is deformed as the liquid is discharged and is constructed to produce a negative pressure.

10. A liquid supply system comprising:

plural liquid supply vessels separate from each other, wherein each liquid supply vessel has a liquid container for accommodating a liquid in a sealed space; and a negative pressure producing member containing vessel which accommodates a negative pressure producing member constructed to hold said liquid internally, said negative pressure producing member containing vessel including an atmosphere communicating port for communicating said negative pressure producing member with atmosphere and plural communicating sections communicated with said plural liquid supply vessels, wherein said plural communicating sections are communicated with liquid containers of said plural separate liquid supply vessels, and said plural separate liquid supply vessels are separable from said negative pressure producing member containing vessel, and wherein air is introduced as liquid is discharged at each communicating section of said plural communicating sections.

11. The liquid supply system according to claim 10, wherein the liquid containers of said liquid supply vessels are deformed as the liquid is discharged and are constructed to produce negative pressures.

12. The liquid supply system according to claim 10, wherein said separate liquid supply vessels each have the same dimensions.

13. The liquid supply system according to claim 10, wherein said plurality of communicating sections are set at heights which are substantially the same.

14. The liquid supply system according to claim 10, wherein said plurality of communicating sections are set at heights which are different from one another.

15. A liquid supply system, comprising:

a liquid supply vessel which has a deformable liquid container for accommodating a liquid in a sealed space, said deformable liquid container deforming and producing negative pressure as liquid is discharged; and a negative pressure producing member containing vessel which accommodates a negative pressure producing member constructed to hold said liquid internally, said negative pressure producing member containing vessel including an atmosphere communicating port for communicating said negative pressure producing member with atmosphere, and plural communicating sections communicated with said liquid supply vessel;

wherein said negative pressure producing member containing vessel is attachable to and detachable from said liquid supply vessel, and wherein said liquid supply vessel is mounted above said negative pressure producing member containing vessel.

16. The liquid supply system according to claim 15, wherein all of said plurality of communicating sections are communicated with the same liquid supply vessel.

17. The liquid supply system according to claim 15, wherein said plurality of communicating sections are communicated with separate liquid supply vessels.

18. A liquid supply vessel constructed for attachable and detachable use with a negative pressure producing member containing vessel which accommodates a negative pressure producing member constructed to hold a liquid internally, the negative pressure producing member containing vessel having an atmosphere communicating port for communicating said negative pressure producing member with atmosphere, said liquid supply vessel comprising:

a deformable liquid container for accommodating a liquid in a sealed space except for a plurality of apertures arranged for communicating with a plurality of communicating sections disposed in said negative pressure producing member containing vessel, said deformable liquid container deforming and producing negative pressure as liquid is discharged, wherein said plurality of apertures are set in use at heights from a bottom surface of said liquid container which are substantially the same.

19. A liquid supply vessel constructed for attachable and detachable use with a negative pressure producing member containing vessel which accommodates a negative pressure producing member constructed to hold a liquid internally, the negative pressure producing member containing vessel having an atmosphere communicating port for communicating said negative pressure producing member with atmosphere, said liquid supply vessel comprising:

a deformable liquid container for accommodating the liquid in a sealed space except for a plurality of apertures arranged for communicating with a plurality of communicating sections disposed in said negative pressure producing member containing vessel, said deformable liquid container deforming and producing negative pressure as liquid is discharged, wherein said liquid supply vessel is mounted above said negative pressure producing member containing vessel.

* * * * *

UNITED STATES PATENT AND TRADEMARK OFFICE

CERTIFICATE OF CORRECTION

PATENT NO. : 6,402,308 B1
DATED : June 11, 2002
INVENTOR(S) : Shozo Hattori et al.

It is certified that error appears in the above-identified patent and that said Letters Patent is hereby corrected as shown below:

Title page,
Item [56], References Cited, FOREIGN PATENT DOCUMENTS,
"EP 08034122" should read -- JP 8-034122 --;
Item [57], ABSTRACT,
Line 2, "container of" should read -- container capable of --.

Column 2,
Line 5, "bag like" should read -- bag-like --; and
Line 41, outside(a" should read -- outside (a --.

Column 5,
Line 19, "diagram" should read -- diagrams --; and
Line 32, "condition" should read -- condition and --.

Column 8,
Line 3, "hereinafter" should read -- hereinafter be --.

Column 9,
Line 44, "flow" should read -- flows --.

Column 11,
Line 37, "a sectional" should read -- sectional --; and
Line 52, "case" should read -- the case --.

Column 12,
Line 25, "case" should read -- the case --;
Line 44, "as a" should read -- as --; and
Line 60, "Since air" should read -- Air --.

Column 13,
Line 39, "a shown" should read -- as shown --; and
Line 64, "case" should read -- the case --.

Column 14,
Line 1, "case" should read -- the case --; and
Line 61, "carriages canning" should read -- carriage scanning --.

UNITED STATES PATENT AND TRADEMARK OFFICE

CERTIFICATE OF CORRECTION

PATENT NO. : 6,402,308 B1
DATED : June 11, 2002
INVENTOR(S) : Shozo Hattori et al.

It is certified that error appears in the above-identified patent and that said Letters Patent is hereby corrected as shown below:

Column 15,
Line 49, “Since the” should read -- The --.

Column 16,
Line 30, “approximately-110” should read -- approximately 110 --.

Column 18,
Line 13, “changes” should read -- changed --.

Column 19,
Line 24, "therefore" should read -- and therefore --;
Line 54, "wall" should read -- walls --; and
Line 57, "the cause such" should read -- such cause --.

Column 20,
Line 16, "is" should be deleted;
Line 32, "according" should read -- according to --; and
Line 35, "inward provides" should read -- inward and provides --.

Column 21,
Line 48, “negative.” should read -- negative --.

Column 22,
Line 60, “13C1 and” should read -- 13D1 and --; and
Line 61, “13C2” should read -- 13D2 --.

Column 24,
Line 7, “view point” should read -- viewpoint --.

Column 25,
Line 11, “an” should read -- a --.

Column 27,
Line 20, “are the” should read -- are --; and
Line 21, “are the” should read -- are --.

Column 28,
Line 10, "chamber in" should read -- chambers are in --;
Line 16, "container" should read -- containers --; and
Line 42, "temporally" should read -- temporarily --.

UNITED STATES PATENT AND TRADEMARK OFFICE

CERTIFICATE OF CORRECTION

PATENT NO. : 6,402,308 B1
DATED : June 11, 2002
INVENTOR(S) : Shozo Hattori et al.

It is certified that error appears in the above-identified patent and that said Letters Patent is hereby corrected as shown below:

Column 31,
Line 19, "applicable" should read -- applicable, --; and
"say" should read say, --; and
Line 40, "film like" should read -- film-like --.

Column 32,
Line 36, "these" should read -- this --; and
Line 62, "region" should read -- region in --.

Column 33,
Line 21, "case" should read -- the case --; and
Line 58, "in" should read -- ink --.

Column 34,
Line 18, “are” should read -- is --.

Column 35,
Line 65, “100” should read -- 100 are --.

Column 37,
Line 39, “is,” should read -- is --.

Signed and Sealed this

First Day of April, 2003

JAMES E. ROGAN
*Director of the United States Patent and Trademark Office*